US011099506B2

(12) United States Patent
Hirose et al.

(10) Patent No.: US 11,099,506 B2
(45) Date of Patent: Aug. 24, 2021

(54) SHEET CONVEYING DEVICE, FIXING DEVICE INCORPORATING THE SHEET CONVEYING DEVICE, AND IMAGE FORMING APPARATUS INCORPORATING THE SHEET CONVEYING DEVICE

(71) Applicant: Ricoh Company, Ltd., Tokyo (JP)

(72) Inventors: Fumihiro Hirose, Kanagawa (JP); Naoto Suzuki, Kanagawa (JP); Yohhei Watanabe, Kanagawa (JP); Akiyasu Amita, Kanagawa (JP); Masateru Ujiie, Kanagawa (JP); Shinichi Namekata, Kanagawa (JP); Takashi Sakamaki, Kanagawa (JP); Teppei Kawata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 134 days.

(21) Appl. No.: 16/030,167

(22) Filed: Jul. 9, 2018

(65) Prior Publication Data

US 2019/0018351 A1 Jan. 17, 2019

(30) Foreign Application Priority Data

Jul. 11, 2017 (JP) ..... JP2017-135675

(51) Int. Cl.
*G03G 15/20* (2006.01)
*G03G 15/00* (2006.01)

(52) U.S. Cl.
CPC ..... *G03G 15/2028* (2013.01); *G03G 15/6529* (2013.01)

(58) Field of Classification Search
CPC ..... G03G 15/2028
USPC ..... 399/400
See application file for complete search history.

(56) References Cited

U.S. PATENT DOCUMENTS

| | | | | |
|---|---|---|---|---|
| 9,494,903 | B2 * | 11/2016 | Shinagawa | G03G 15/2025 |
| 10,409,203 | B2 * | 9/2019 | Tanaka | G03G 15/2025 |
| 2006/0045590 | A1 * | 3/2006 | Yamada | G03G 15/2053 399/329 |

(Continued)

FOREIGN PATENT DOCUMENTS

| | | |
|---|---|---|
| JP | 2006-072246 A | 3/2006 |
| JP | 2006-259341 | 9/2006 |

(Continued)

OTHER PUBLICATIONS

Office Action dated Jan. 29, 2021 in Japanese Patent Application No. 2017-135675, 3 pages.

*Primary Examiner* — Anthony H Nguyen
(74) *Attorney, Agent, or Firm* — Xsensus LLP

(57) ABSTRACT

A sheet conveying device, which is included in a fixing device and an image forming apparatus, includes a sheet contacting body and a lateral relative position shifting body. The sheet contacting body is configured to contact a sheet to be conveyed. The lateral relative position shifting body is configured to shift a passing position of the sheet being conveyed toward the sheet contacting body, in a width direction perpendicular to a sheet conveying direction and a relative position to the sheet contacting body, each time the sheet is conveyed by a number of sheets based on a setting. The setting of the number of sheets varies based on information of the sheet.

19 Claims, 12 Drawing Sheets

(56) References Cited

U.S. PATENT DOCUMENTS

2007/0212135 A1* 9/2007 Suenaga ..... G03G 15/2028 399/329
2008/0038027 A1* 2/2008 Ito ..... G03G 15/2025 399/328
2008/0152404 A1* 6/2008 Yoshino ..... G03G 15/2028 399/329
2009/0123203 A1* 5/2009 Tanaka ..... G03G 15/2057 399/330
2009/0274477 A1 11/2009 Okamoto et al.
2009/0274494 A1 11/2009 Okamoto et al.
2009/0274495 A1 11/2009 Okamoto et al.
2009/0274496 A1 11/2009 Okamoto et al.
2009/0274497 A1 11/2009 Okamoto et al.
2009/0274498 A1 11/2009 Okamoto et al.
2009/0297233 A1* 12/2009 Kameda ..... G03G 15/5029 399/322
2010/0074667 A1* 3/2010 Ehara ..... G03G 15/2028 399/395
2010/0316397 A1 12/2010 Kudou et al.
2011/0280636 A1* 11/2011 Nakamura ..... G03G 15/2025 399/327
2012/0044516 A1 2/2012 Hirose et al.
2012/0045260 A1 2/2012 Yamamoto et al.
2012/0051805 A1 3/2012 Suzuki et al.
2012/0213539 A1* 8/2012 Maruko ..... G03G 15/2025 399/67
2012/0224893 A1 9/2012 Yamamoto et al.
2013/0142551 A1 6/2013 Yamano et al.
2013/0308966 A1* 11/2013 Masuda ..... G03G 15/55 399/33
2014/0112680 A1 4/2014 Ueno et al.
2014/0119762 A1 5/2014 Suzuki et al.
2014/0212188 A1 7/2014 Watanabe
2014/0294456 A1 10/2014 Ueno et al.
2014/0294461 A1 10/2014 Tokuda et al.
2015/0023711 A1* 1/2015 Kawanago ..... G03G 15/6558 399/394
2015/0078770 A1 3/2015 Yamano et al.
2015/0227097 A1 8/2015 Yamano et al.
2015/0268598 A1* 9/2015 Nagata ..... G03G 15/2025 399/327
2015/0323892 A1 11/2015 Sakamaki et al.
2016/0004199 A1 1/2016 Suzuki et al.
2016/0124357 A1 5/2016 Ujiie et al.
2016/0124361 A1 5/2016 Watanabe et al.
2016/0170350 A1 6/2016 Hirose et al.
2016/0202646 A1 7/2016 Suzuki et al.
2016/0306304 A1 10/2016 Hemmi et al.
2016/0363898 A1 12/2016 Ujiie
2017/0090368 A1 3/2017 Ujiie et al.
2017/0097600 A1 4/2017 Kawata et al.
2017/0205745 A1 7/2017 Suzuki et al.
2017/0235259 A1 8/2017 Saitoh et al.
2017/0269522 A1 9/2017 Kubota et al.
2017/0269525 A1 9/2017 Okamoto et al.
2017/0269526 A1 9/2017 Yuasa et al.
2017/0357197 A1 12/2017 Okamoto et al.
2017/0357198 A1 12/2017 Namekata et al.
2018/0081309 A1 3/2018 Hirose et al.
2018/0088502 A1 3/2018 Sugiyama et al.

FOREIGN PATENT DOCUMENTS

JP 2011-175067 9/2011
JP 2012-078679 4/2012
JP 2012-123166 A 6/2012
JP 2013-033151 2/2013
JP 2013-054306 3/2013
JP 2016-206644 A 12/2016

* cited by examiner

SHEET CONVEYING DEVICE, FIXING DEVICE INCORPORATING THE SHEET CONVEYING DEVICE, AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2017-135675, filed on Jul. 11, 2017, in the Japan Patent Office, the entire disclosure of which is hereby incorporated by reference herein.

BACKGROUND

Technical Field

This disclosure relates to a sheet conveying device, a fixing device incorporating the sheet conveying device, and an image forming apparatus incorporating the sheet conveying device.

Related Art

Various types of image forming apparatuses are known to include a fixing member that contacts a recording medium being conveyed, so as to fix an image formed on the recording medium to the recording medium. Such image forming apparatuses are also known to include a member to shift a passing position located along a width direction that is perpendicular to a conveying direction of the recording medium toward the fixing member, each time a predetermined amount of recording media is conveyed.

As an example, a known image forming apparatus includes a configuration to prevent concentration of scratches on the edge of the fixing member on a specific portion, due to shift of the passing position of the recording medium and continuous contact of an edge portion at a lateral end of the recording medium to the specific portion of the fixing member.

SUMMARY

At least one aspect of this disclosure provides a sheet conveying device including a sheet contacting body and a lateral relative position shifting body. The sheet contacting body is configured to contact a sheet to be conveyed. The lateral relative position shifting body is configured to shift a passing position of the sheet being conveyed toward the sheet contacting body, in a width direction perpendicular to a sheet conveying direction and a relative position to the sheet contacting body, each time the sheet is conveyed by a number of sheets based on a setting. The setting of the number of sheets varies based on information of the sheet.

Further, at least one aspect of this disclosure provides an image forming apparatus including an image forming device and the above-described sheet conveying device. The image forming device is configured to form an image on a sheet. The sheet conveying device is configured to convey the sheet.

Further, at least one aspect of this disclosure provides a fixing device including a fixing body and the above-described sheet conveying device. The fixing body is configured to contact a sheet being conveyed and having an image formed thereon and to fix the image to the sheet. The sheet contacting is the fixing body.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
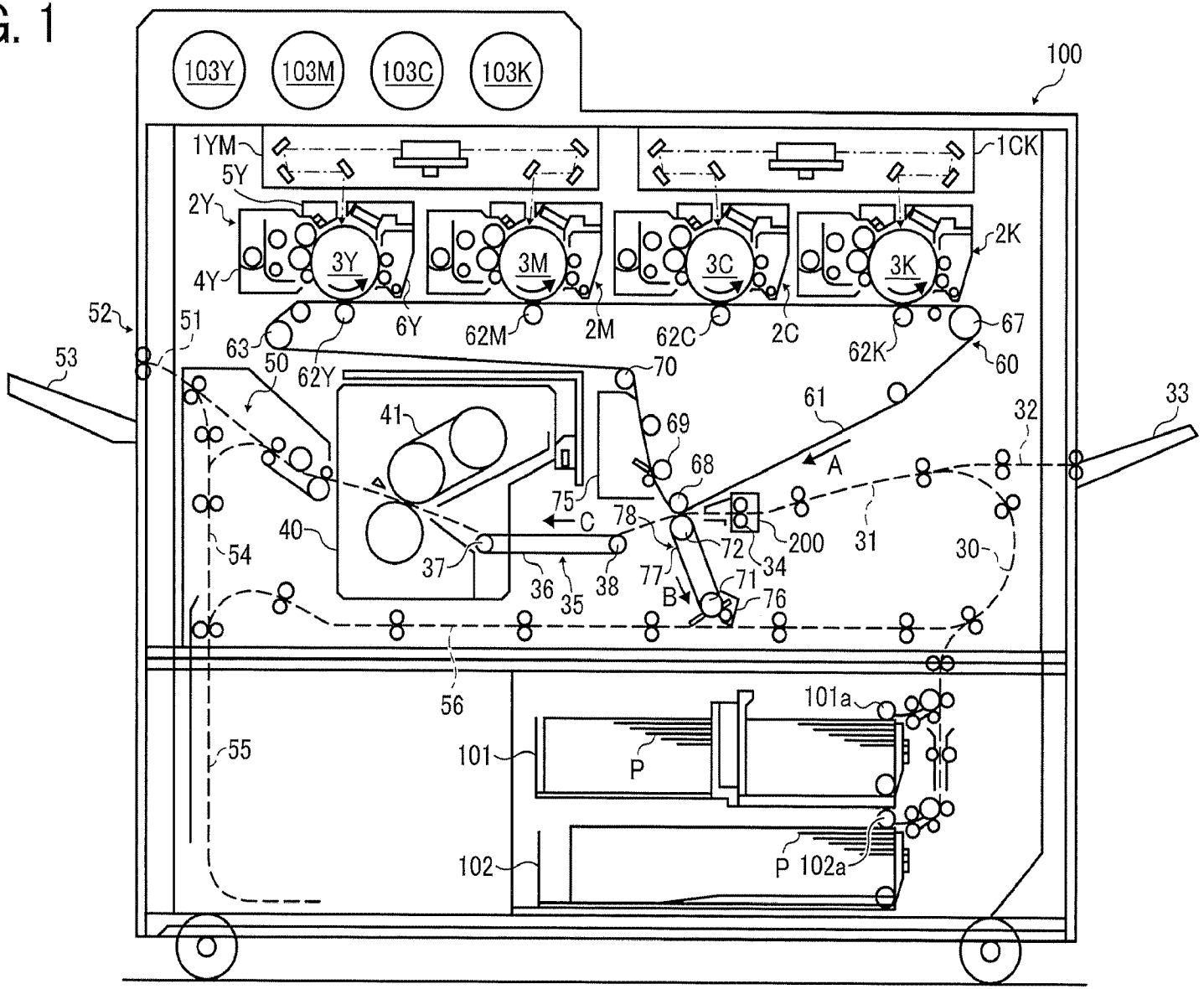
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device, a fixing device incorporating the sheet conveying device and an image forming apparatus incorporating the sheet conveying device.

It is to be noted that elements (for example, mechanical parts and components) having the same functions and shapes are denoted by the same reference numerals throughout the specification and redundant descriptions are omitted.

Now, a description is given of an electrophotographic image forming apparatus 100 for forming images by electrophotography, according to an embodiment of this disclosure. It is to be noted that, hereinafter, the electrophotographic image forming apparatus 100 is referred to as the image forming apparatus 100.

The image forming apparatus 100 may be a copier, a facsimile machine, a printer, a multifunction peripheral or a multifunction printer (WP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

FIG. 1 is a schematic diagram illustrating the image forming apparatus 100 according to an embodiment of this disclosure. The image forming apparatus 100 includes four image forming units 2Y, 2M, 2C, and 2K to form yellow (Y), magenta (M), cyan (C), and black (K) toner images, respectively. The image forming apparatus 100 is a tandem image forming apparatus in which the four image forming units 2Y, 2M, 2C and 2K are aligned along a direction of movement of an intermediate transfer belt 61 as an image bearing belt in an endless loop.

The image forming apparatus 100 further includes a sheet feed passage 30, a pre-transfer sheet conveyance passage 31, a bypass sheet feed passage 32, a bypass tray 33, a pair of registration rollers 34, a sheet conveyance belt unit 35, a fixing device 40, a conveyance direction switching device 50, a sheet ejection passage 51, a pair of sheet output rollers 52, and a sheet output tray 53. The image forming apparatus 100 further includes two optical writing devices 1YM and 1CK, a primary transfer unit 60, a secondary transfer unit 78, a first sheet container 101 and a second sheet container 102.

The four image forming units 2Y, 2M, 2C and 2K include drum-shaped photoconductors 3Y, 3M, 3C and 3K that function as latent image bearers, respectively. Each of the first sheet container 101 and the second sheet container 102 contains a sheet bundle of sheets P that function as recording media. The bundle of sheets P includes a sheet P that functions as a recording sheet. The first sheet container 101 includes a first sheet feed roller 101*a* and the second sheet container 102 includes a second sheet feed roller 102*a*. As a selected one of the first sheet feed roller 101*a* and the second sheet feed roller 102*a* is driven and rotated, an uppermost sheet P placed on top of the sheet bundle is fed toward a sheet feed passage 30.

The image forming apparatus 100 includes a housing in which parts and components for image formation are contained. A bypass tray 33 is disposed openably and closably on a right side of the housing of the image forming apparatus 100 in FIG. 1. A sheet bundle of sheets P are loaded on a top face of the bypass tray 33 when the bypass tray 33 is rotated away from the housing to open. The uppermost sheet P on top of the sheet bundle loaded on the bypass tray 33 is fed by a sheet feed roller included in the bypass tray 33, toward the bypass sheet feed passage 32.

Each of the optical writing devices 1YM and 1CK includes a laser diode, a polygon mirror, various lenses, and so forth. Based on image data that is optically read by a scanner disposed outside the housing of the image forming apparatus 100 or image data output from a personal computer disposed outside the image forming apparatus 100, each of the optical writing devices 1YM and 1CK emits laser light from a laser diode to optically scan the photoconductors 3Y, 3M, 3C and 3K of the image forming units 2Y, 2M, 2C and 2K, respectively. Specifically, respective drive devices drive and rotate the photoconductors 3Y, 3M, 3C and 3K of the image forming units 2Y, 2M, 2C and 2K, respectively, in a counterclockwise direction in FIG. 1.

The optical writing device 1YM emits laser light beams to the photoconductor 3Y for forming yellow image and the photoconductor 3M for forming magenta image by deflecting the laser light beams in an axial direction of rotation of the photoconductors 3Y and 3M. Accordingly, respective surfaces of the photoconductors 3Y and 3M are optically scanned and irradiated. Accordingly, an electrostatic latent image based on yellow image data is formed on the photoconductor 3Y and an electrostatic latent image based on magenta image data is formed on the photoconductor 3M.

The optical writing device 1CK emits laser light beams to the photoconductor 3C for forming cyan image and the photoconductor 3K for forming black image by deflecting the laser light beams in an axial direction of rotation of the photoconductors 3C and 3K, respectively. Accordingly, respective surfaces of the photoconductors 3C and 3K are optically scanned and irradiated. Accordingly, an electrostatic latent image based on cyan image data is formed on the photoconductor 3C and an electrostatic latent image based on black image data is formed on the photoconductor 3K.

Each of the image forming units 2Y, 2M, 2C and 2K also includes various image forming components disposed around each of the photoconductors 3Y, 3M, 3C and 3K. Each of the photoconductors 3Y, 3M, 3C and 3K and the various image forming components are supported by a common supporting body (i.e., each of the image forming units 2Y, 2M, 2C and 2K) as a single unit. According to this configuration, each image forming unit 2 including each photoconductor 3 and various image forming components is attached to or detached from the housing of the image forming apparatus 100 integrally. The image forming units 2Y, 2M, 2C and 2K have respective configurations identical to each other except the colors of toners, and therefore are occasionally described without suffixes indicating the toner colors, which are Y, M, C, and K.

The image forming unit 2 (i.e., the image forming units 2Y, 2M, 2C and 2K) includes the photoconductor 3 (i.e., the photoconductors 3Y, 3M, 3C and 3K) and a developing device 4 (i.e., developing devices 4Y, 4M, 4C and 4K) that develops an electrostatic latent image formed on a surface of the photoconductor 3 into a visible toner image.

The image forming unit 2 further includes a charging device 5 (i.e., charging devices 5Y, 5M, 5C and 5K) that uniformly charges a surface of the photoconductor 3 that is rotated by the drive device.

The image forming unit 2Y further a drum cleaning device 6 (i.e., drum cleaning devices 6Y, 6M, 6C and 6K). The drum cleaning device 6 removes transfer residual toner remaining on the surface of the photoconductor 3 after the photoconductor 3 has passed the primary transfer nip region and cleans the surface of the photoconductor 3.

The photoconductor 3 is manufactured by a hollow tube made of aluminum, for example, with a drum shaped body covered by an organic photoconductive layer having photosensitivity. It is to be noted that the photoconductors 3Y, 3M, 3C, and 3K may include an endless belt instead of a drum.

The developing device 4 (i.e., the developing devices 4Y, 4M, 4C and 4K) includes a developing sleeve and a magnet roller. The developing sleeve is a tubular-shaped rotatable non-magnetic body. The magnet roller is fixed to the developing sleeve, on an inner surface of a hollow of the developing sleeve, in such a way as not to rotate together with the developing sleeve. Due to magnetic force generated by the magnet roller, an electrostatic latent image formed on the photoconductor 3 is developed into a visible toner image by a two-component developer, including magnetic carrier particles and non-magnetic toner, borne on the surface of the developing sleeve. Hereinafter, the two-component developer is simply referred to as "developer".

Yellow, magenta, cyan, and black toners stored in respective toner bottles 103Y, 103M, 103C and 103K are supplied appropriately by respective toner supplying devices to the developing devices 4Y, 4M, 4C and 4K, respectively. The developing device 4 includes a toner concentration sensor that functions as a toner concentration detector. The toner concentration sensor detects the permeability of the developer due to the magnetic carrier particles. A controller 400 controls driving of each toner supplying device based on a comparison obtained by an output value from the toner concentration sensor and an output value of a target output value that is a target toner concentration value, from the toner concentration sensor. Accordingly, the toner concentration of the developer is set to fall in a constant range, which is from 4 wt % to 9 wt %, for example.

The drum cleaning device 6 scrapes off transfer residual toner from the surface of the photoconductor 3 by a cleaning blade made by polyurethane rubber, while the cleaning blade is in contact with the photoconductor 3. It is to be noted that the drum cleaning device 6 is not limited thereto. This disclosure is applied to a drum cleaning device having a different configuration. In order to enhance the cleaning performance, the drum cleaning device 6 further includes a fur brush that has a rotary body in addition to the cleaning blade. The fur brush is also disposed in contact with the photoconductor 3. This fur brush scrapes a solid lubricant into powder and applies the lubricant powder to the surface of the photoconductor 3.

An electric discharging lamp is disposed above the photoconductor 3. The electric discharging lamp is also a part of the image forming unit 2. Further, the electric discharging lamp optically emits light to the surface of the photoconductor 3 to remove electricity from the surface of the photoconductor 3 after the photoconductor 3 has passed a position opposed to the drum cleaning device 6. The discharged surface of the photoconductor 3 is uniformly charged by the charging device 5. Then, a corresponding one of the above-described optical writing devices 1YM and 1CK starts optical scanning. It is to be noted that the charging device 5 rotates while receiving the charging bias from a power source. Instead of this configuration, the charging device 5 may employ a scorotron charging system in which a charging operation is performed without contacting the photoconductor 3.

The primary transfer unit 60 is disposed below the four image forming units 2Y, 2M, 2C and 2K. The intermediate transfer belt 61 that functions as an image bearer is stretched in a tensioned condition by multiple rollers (i.e., rollers 63, 67, 69 and 70 and a secondary transfer bias roller 68). While contacting the photoconductors 3Y, 3M, 3C and 3K, the intermediate transfer belt 61 is moved endlessly in a counterclockwise direction as indicated by arrow A in FIG. 1, by rotation of any one of the multiple rollers. By so doing, primary transfer nip regions for respective colors of yellow, magenta, cyan and black are formed, in which the respective photoconductors 3Y, 3M, 3C and 3K and the intermediate transfer belt 61 contact.

In the vicinity of each of the primary transfer nip regions, the primary transfer roller 62 (i.e., the primary transfer rollers 62Y, 62M, 62C and 62K) are disposed in contact with an inner loop of the intermediate transfer belt 61 to press the intermediate transfer belt 61 against the photoconductor 3 (i.e., the photoconductors 3Y, 3M, 3C and 3K), respectively. A primary transfer power source applies respective primary transfer biases to the primary transfer rollers 62Y, 62M, 62C and 62K. With this action, respective primary transfer electric fields are formed in the respective primary transfer nip regions for yellow, magenta, cyan and black toner images, so that the yellow, magenta, cyan and black toner images formed on the photoconductors 3Y, 3M, 3C and 3K, respectively, are electrostatically transferred onto the intermediate transfer belt 61.

Along with the endless movement of the intermediate transfer belt 61 in the clockwise direction A in FIG. 1, the intermediate transfer belt 61 passes through the respective primary transfer nip regions for the yellow, magenta, cyan and black toner images sequentially. At the primary transfer nip regions, the yellow, magenta, cyan and black toner images are sequentially transferred and overlaid onto the front surface of the intermediate transfer belt 61 for primary transfer. Due to the primary transfer of the toner images, a four-color composite toner image (hereinafter referred to as a four-color toner image) is formed on the front surface of the intermediate transfer belt 61.

A secondary transfer unit 78 is disposed below the intermediate transfer belt 61 in FIG. 1. This secondary transfer unit 78 includes a secondary transfer belt 77 having an endless loop, a grounding driven roller 72, a secondary transfer drive roller 71, a secondary belt cleaning device 76, and a toner adhesion amount detecting sensor. While being stretched in a tensioned condition by the grounding driven roller 72 disposed inside the endless loop and the secondary transfer drive roller 71, the secondary transfer belt 77 is moved endlessly in a counterclockwise direction as indicated by arrow B in FIG. 1, along with rotation of the secondary transfer drive roller 71.

The secondary transfer belt 77 of the secondary transfer unit 78 is wound around the grounding driven roller 72 and the intermediate transfer belt 61 of the primary transfer unit 60 is wound around the secondary transfer bias roller 68. The secondary transfer belt 77 at a contact portion contacting the grounding driven roller 72 is pressed against the intermediate transfer belt 61 at a contact portion contacting the secondary transfer bias roller 68. Thus, a secondary transfer nip region is formed in a portion in which the secondary transfer belt 77 and the intermediate transfer belt 61 contact each other. A secondary transfer bias that is output from a secondary transfer power source is applied to the secondary transfer bias roller 68 disposed at an inner side of the endless loop of the intermediate transfer belt 61. By contrast, the grounding driven roller 72 disposed at an inner side of the endless loop of the secondary transfer belt 77 is grounded. Accordingly, a secondary transfer electric field is formed in the secondary transfer nip region.

The pair of registration rollers 34 is disposed on the right side of the secondary transfer nip region in FIG. 1. The pair of registration rollers 34 holds the sheet P between the rollers thereof to convey the sheet P to the secondary transfer nip region in synchronization with arrival of the four-color toner image formed on the intermediate transfer belt 61 (at a time at which the sheet P and the four-color toner image are conveyed to meet each other at the same time). In the secondary transfer nip region, the four-color toner image formed on the intermediate transfer belt 61 is transferred collectively onto the sheet P due to the secondary transfer electric field and the nip pressure. At this time, the four-color toner image is combined with white color of the sheet P to make a full color image.

After passing through the secondary transfer nip region, secondary transfer residual toner that has not been transferred onto the sheet P remains on the front surface of the intermediate transfer belt 61. An intermediate transfer belt cleaning device 75 provided to the primary transfer unit 60 removes the secondary transfer residual toner from the front surface of the intermediate transfer belt 61.

After passing through the secondary transfer nip region, the sheet P is separated from the intermediate transfer belt 61 and the secondary transfer belt 77 to be conveyed toward the sheet conveyance belt unit 35. The sheet conveyance belt unit 35 includes a transfer belt 36 having an endless loop, a sheet conveying drive roller 37, and a sheet conveying driven roller 38. In the sheet conveyance belt unit 35, while being stretched in a tensioned condition by the sheet conveying drive roller 37 and the sheet conveying driven roller 38, the transfer belt 36 is moved endlessly in the counterclockwise direction as indicated by arrow C in FIG. 1, along with rotation of the sheet conveying drive roller 37. After the sheet P has passed through the secondary transfer nip region, while being held by an upper stretched surface of the transfer belt 36, the sheet P is conveyed along with endless movement of the transfer belt 36, toward the fixing device 40.

The fixing device 40 includes a fixing belt 41 having an endless loop and a pressure roller 44. The fixing belt 41 and the pressure roller 44 contact to form a fixing nip region therebetween, into which the sheet P is held in the fixing device 40. Due to application and heat, the toner image formed on the sheet P is fixed to the sheet P.

The toner image is transferred onto a first face of the sheet P in the secondary transfer nip region and is fixed to the first face of the sheet P in the fixing device 40. Thereafter, the sheet P is conveyed toward the conveyance direction switching device 50. The image forming apparatus 100 according to the present embodiment of this disclosure further includes the conveyance direction switching device 50, a re-entry passage 54, a switchback passage 55 and a post-switchback passage 56. The conveyance direction switching device 50 switches a route of conveyance of the sheet P after the sheet P is output from the fixing device 40, between the sheet ejection passage 51 and the re-entry passage 54.

Specifically, when performing a print job in a single-side printing mode in which an image is formed on a single side, i.e., the first face of the sheet P, the conveyance direction switching device 50 selects the route of conveyance of the sheet P to the sheet ejection passage 51. According to the setting, the sheet P having the image on the first face is conveyed toward the pair of sheet output rollers 52 via the sheet ejection passage 51 to be ejected to the sheet output tray 53 that is attached to an outside of the image forming apparatus 100.

Further, when performing a print jot in a duplex printing mode in which respective images are formed on both sides, i.e., the first face and a second face of the sheet P, after the sheet P having fixed images on both first and second faces is conveyed from the fixing device 40, the conveyance direction switching device 50 also selects the route of conveyance of the sheet P to the sheet ejection passage 51. According to the setting, the sheet P having images on both first and second faces is conveyed and ejected to the sheet output tray 53.

By contrast, when performing a print job in the duplex printing mode, after the recording sheet P having a fixed image on the first face alone is conveyed from the fixing device 40, the conveyance direction switching device 50 selects a route of conveyance of the recording sheet P to the re-entry passage 54. The re-entry passage 54 is connected to the switchback passage 55. The sheet P conveyed to the re-entry passage 54 enters the switchback passage 55. Consequently, when the entire region of the sheet P in the sheet conveying direction enters the switchback passage 55, the route of conveyance of the sheet P is reversed, so that the sheet P is switched back in the reverse direction.

The switchback passage 55 is connected to the post-switchback passage 56 as well as the re-entry passage 54. The sheet P that has been switched back in the reverse direction enters the post-switchback passage 56. At this time, the faces of the sheet P are reversed. Consequently, the reversed sheet P is conveyed to the secondary transfer nip region again via the post-switchback passage 56 and the sheet feed passage 30. A toner image is transferred onto the second face of the sheet P in the secondary transfer nip region. Thereafter, the sheet P is conveyed to the fixing device 40 so as to fix the toner image to the second face of the sheet P. Then, the sheet P passes through the conveyance direction switching device 50, the sheet ejection passage 51, and the pair of sheet output rollers 52 before being ejected on the sheet output tray 53.

Figure 2:
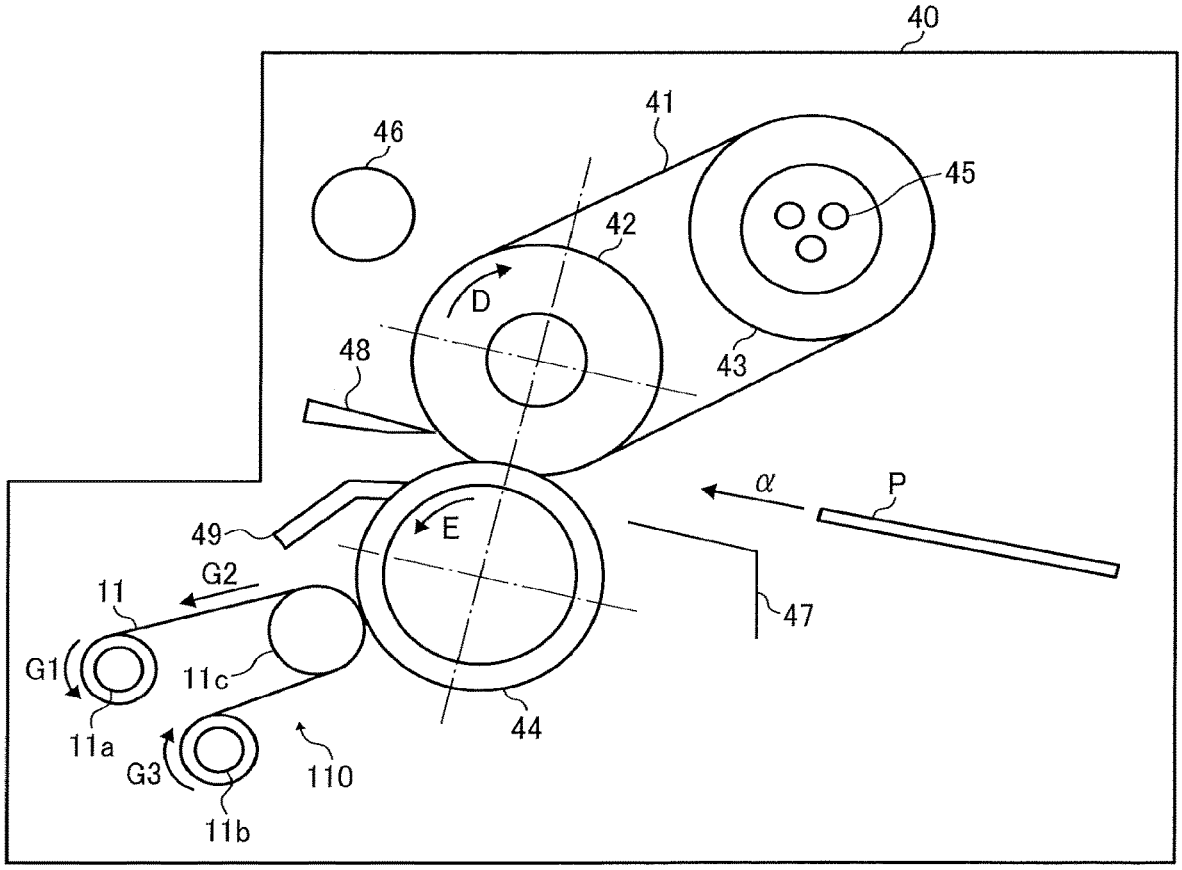
FIG. 2 is a schematic cross sectional view illustrating a fixing device.

FIG. 2 is a schematic cross sectional view illustrating the fixing device 40.

The fixing device 40 illustrated in FIG. 2 includes the fixing belt 41 that functions as a fixing body to contact a face on which an unfixed toner image on the sheet P is formed. The fixing belt 41 is stretched by a fixing roller 42 and a heat roller 43. The fixing roller 42 is a fixing belt drive roller and the heat roller 43 is a fixing belt driven roller. As the fixing roller 42 is driven and rotated in the clockwise direction as indicated by arrow D in FIG. 2, the fixing belt 41 is rotated in the clockwise direction in FIG. 2.

The heat roller 43 is a heater that is a rotary body including a fixing heater 45. The fixing roller 42 is a rotary body that functions as a fixing nip forming body to stretch the fixing belt 41 together with the heat roller 43.

In the fixing device 40, the pressure roller 44 is disposed below the fixing roller 42. The pressure roller 44 is disposed facing the fixing roller 42 with the fixing belt 41 interposed therebetween. The pressure roller 44 is pressed against the fixing roller 42 via the fixing belt 41 by a pressing mechanism.

The fixing heater 45 that functions as a heat source is disposed inside the heat roller 43, so that the heat roller 43 is heated by the fixing heater 45. Consequently, the fixing belt 41 is heated by the heat roller 43. The fixing belt 41 is rotated along with rotation of the fixing roller 42 driven by a driving mechanism. The pressure roller 44 is rotated by rotation of the fixing belt 41, in the counterclockwise direction as indicated by arrow E in FIG. 2.

The surface temperature of the fixing belt 41 is detected by temperature detecting element such as a known temperature sensor. A known temperature control unit controls the fixing heater 45 to adjust the surface temperature of the fixing belt 41 to be a predetermined temperature, based on the output value of the temperature detecting element. As an example of control of the fixing heater 45, an ON/OFF control or a PID (proportional integral differential) control is used.

The sheet P having an unfixed toner image thereon is conveyed along an entrance guide plate 47 to the fixing device 40 as indicated by arrow $\alpha$ in FIG. 2. Then, the sheet P passes through the fixing nip region that is a nip region formed between the fixing belt 41 and the pressure roller 44 via the fixing roller 42. The toner image on the sheet P is melted and fixed to the sheet P in the fixing nip region formed between the fixing belt 41 that is controlled at a predetermined temperature and the pressure roller 44. The sheet P after passing the fixing nip region is separated from the fixing belt 41 and the pressure roller 44 at a nip region exit by a fixing separation plate 48 and a pressure separation claw 49. Then, the sheet P passes through the sheet conveyance passage and the sheet ejection passage 51 in the conveyance direction switching device 50 and is ejected to an outside of the image forming apparatus 100 onto the sheet output tray 53.

The fixing device 40 includes a refresh roller 46 that slides on the surface of the fixing belt 41. When image formation is performed, the refresh roller 46 is disposed not to contact the fixing belt 41.

Then, after a constant amount of sheets P has been conveyed, in other words, after the end of a print job, the refresh roller 46 comes to contact the fixing belt 41.

Figure 3:
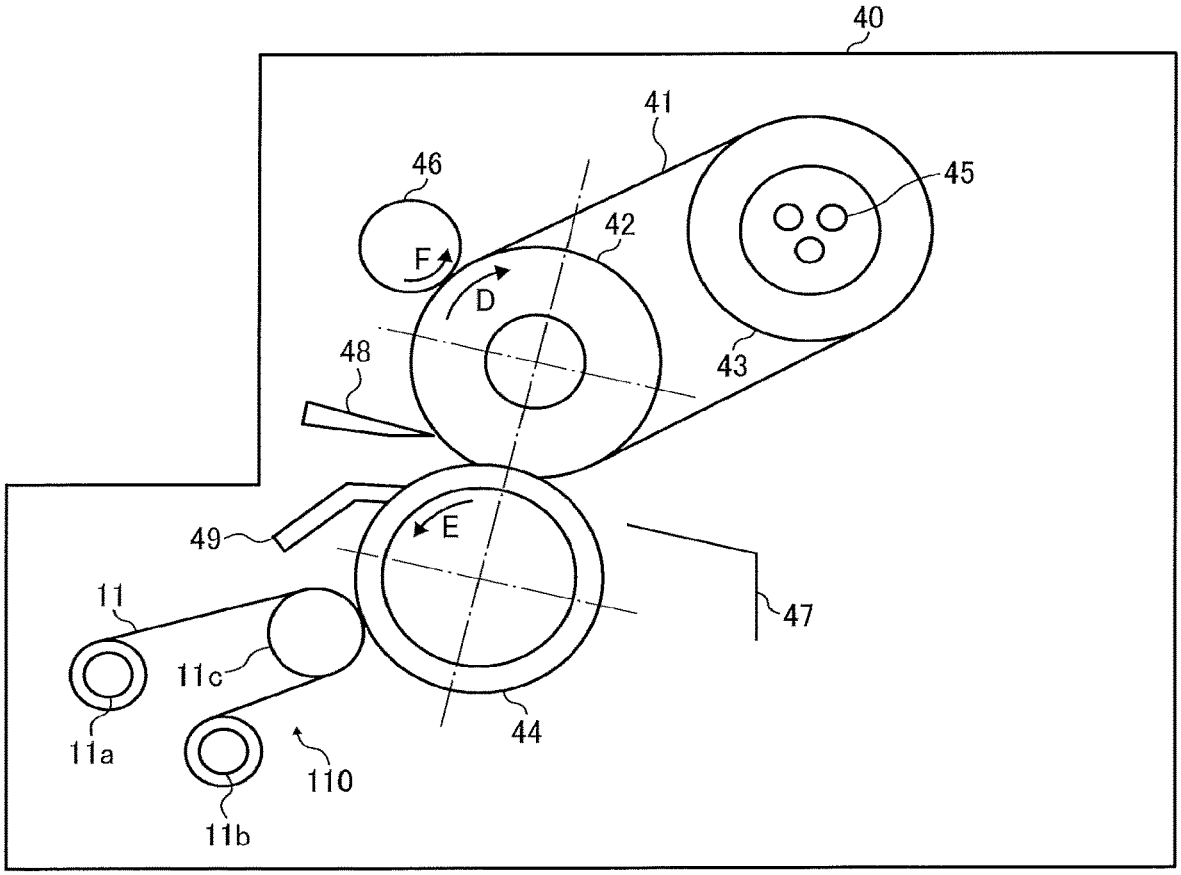
FIG. 3 is a schematic cross sectional view illustrating the fixing device with a refresh roller in contact with a fixing belt.

FIG. 3 is a schematic cross sectional view illustrating the fixing device 40 with the refresh roller 46 in contact with the fixing belt 41.

As illustrated in FIGS. 2 and 3, the fixing device 40 includes a pressure roller cleaning device 110 to clean the surface of the pressure roller 44. The pressure roller cleaning device 110 includes a cleaning web 11 that functions as a band-shaped cleaner, a web holding shaft 11*b*, a web take-up shaft 11*a* and a web contact roller 11*c*. One end of the cleaning web 11 is fixed to the web take-up shaft 11*a* and an opposed end of the cleaning web 11 is fixed to the web holding shaft 11*b*. A portion formed between the web take-up shaft 11*a* and the web holding shaft 11*b* of the cleaning web 11 is pressed against the surface of the pressure roller 44 by the web contact roller 11*c*.

The web take-up shaft 11*a* is driven and rotated in a direction indicated by arrow G1 in FIG. 2, so that the cleaning web 11 is taken up. Then cleaning web 11 has a portion to contact the pressure roller 44 for cleaning. The portion of the cleaning web 11 is moved in a direction indicated by arrow G2 in FIG. 2. By so doing, unused portion of the cleaning web 11 contacts the pressure roller 44. The unused portion of the cleaning web 11 is taken up to the web holding shaft 11*b*. Then, as the cleaning web 11 is moved and pulled in the direction G2 in FIG. 2, the web holding shaft 11*b* is rotated in a direction indicated by arrow G3 in FIG. 2. By so doing, the unused portion of the cleaning web 11 is conveyed toward a contact portion at which the unused portion of the cleaning web 11 and the pressure roller 44 contact. By cleaning the surface of the pressure roller 44 by the cleaning device using the cleaning web 11 that functions as a cleaner, the cleaning device continuously cleans the pressure roller 44 with a portion in which no foreign material of the cleaner is attached. Accordingly, the pressure roller 44 may be continuously maintained in a state in which there is no foreign material on the surface thereof.

In a case in which, an image with a large toner adhesion amount on the surface of a sheet P having a width wider or greater than the maximum sheet feed width (hereinafter, occasionally referred to as a "wide width sheet P") was output after some sheets P having a width narrower or smaller than the maximum sheet feed width (hereinafter, occasionally referred to as a "narrow width sheet P") had been fed, the following failure have occurred. Specifically, in the width direction perpendicular to a sheet conveying direction of the sheet P (as indicated by arrow "α"), the image in the area in which both ends of some narrow width sheets P have passed has the fixing ability different from the other area of the image, and therefore there had been a case in which defect images having failure such as gloss streaks occurred.

Figure 4:
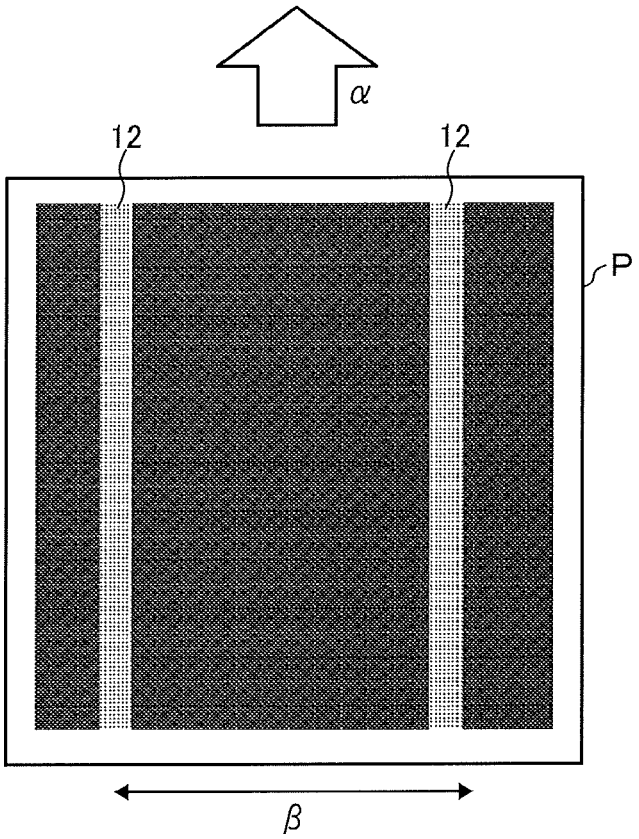
FIG. 4 is a diagram illustrating an example of a sheet having gloss streaks thereon.

FIG. 4 is a diagram illustrating an example of a sheet P having gloss streaks 12 thereon when a solid image is formed on a wide width sheet P after some narrow width sheets P have been fed. In the example illustrated in FIG. 4, there are two gloss streaks 12 in the width direction (as indicated by arrow "β" in FIG. 4), each having a stripe streak along the sheet conveying direction.

These gloss streaks have occurred based on the following reasons. When a number of narrow width sheets P that is beyond a predetermined number and is narrower in the width direction than the maximum sheet feed width is fed, sliding traces are repeatedly formed at the same positions of the fixing belt 41 in the width direction due to respective burrs at both lateral ends of the narrow width sheets P. By repeated forming the sliding traces at the same positions, edge scratches are generated. As a result, the image fixed at the positions having the edge scratches is generated as the gloss streaks 12 on an output image.

As illustrated in FIG. 3, in a case in which the refresh roller 46 slides on the surface of the fixing belt 41, the refresh roller 46 comes to contact with the fixing belt 41. Then, in order to cause the surface moving direction of the refresh roller 46 at the contact position with the fixing belt 41 to be equal to the fixing belt 41, the refresh roller 46 is rotated in a direction indicated by arrow "F" in FIG. 3.

Further, by pressing the refresh roller 46 against the fixing roller 42 via the fixing belt 41, the sliding traces formed on the surface of the fixing belt 41 due to the burrs at both lateral ends of the sheet P can be fixed and repaired. Accordingly, the gloss streaks 12 as illustrated in FIG. 4 is prevented from occurring or is made difficult to see even if generated.

Regarding the rotation speed of the refresh roller 46 in the fixing device 40 according to the present embodiment, the surface moving speed of the refresh roller 46 is set to be three (3) to six (6) times faster than the surface moving speed of the fixing belt 41. This setting of the surface moving speed of the refresh roller 46 is appropriate to fix and repair the edge scratches of the fixing belt 41.

If the surface moving speed of the refresh roller 46 is less than three times, sufficient polishing of the fixing belt 41 is not achieved. By contrast, if the surface moving speed of the refresh roller 46 exceeds six times, it is likely that the surface life of the fixing belt 41 is reduced. By contrast, by setting the surface moving speed of the refresh roller 46 to be three to six times faster than the surface moving speed of the fixing belt 41, the sliding traces on the fixing belt 41 are removed by polishing and, at the same time, a reduction in the service life of the fixing belt 41 is restrained.

In the fixing device 40, when the refresh roller 46 slides on the fixing belt 41, the pressure roller 44 is pressed against the fixing belt 41 in the pressing state. According to this configuration, slipping of the fixing belt 41 due to sliding of the refresh roller 46 thereon is prevented.

Further, as illustrated in FIG. 1, the image forming apparatus 100 according to the present embodiment further includes a sheet shifting device 200 that shifts the sheet P held by the pair of registration rollers 34, in the width direction of the sheet P.

Figure 5:
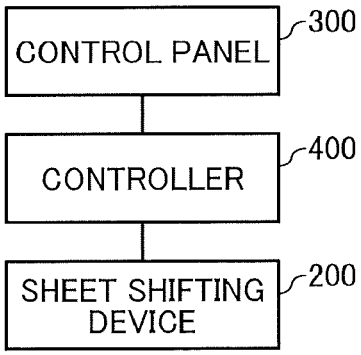
FIG. 5 is a block diagram illustrating a configuration to change a setting point of a sheet in a width direction thereof.

FIG. 5 is a block diagram illustrating a configuration to change a setting point of the sheet P in the width direction of the sheet P. In other words, FIG. 5 is a block diagram illustrating a configuration that controls the sheet shifting device 200.

As an example of a sheet shifting body such as the sheet shifting device 200 to cause the sheet P held by the rollers of the pair of registration rollers 34 to shift in the width direction, a known sheet shifting device such as a sheet feed position shifting mechanism may be employed.

Now, a description is given of the sheet shifting device 200 having the configuration similar to the comparative sheet feed position shifting mechanism.

In the comparative sheet feed position shifting mechanism, a pair of shift rollers shifts to the right side direction relative to a home position thereof. By contrast, in the sheet shifting device 200 according to the present embodiment, the pair of registration rollers 34 that functions as a pair of shift rollers shifts and moves to both the left side direction and the right side direction relative to the home position.

Figure 6:
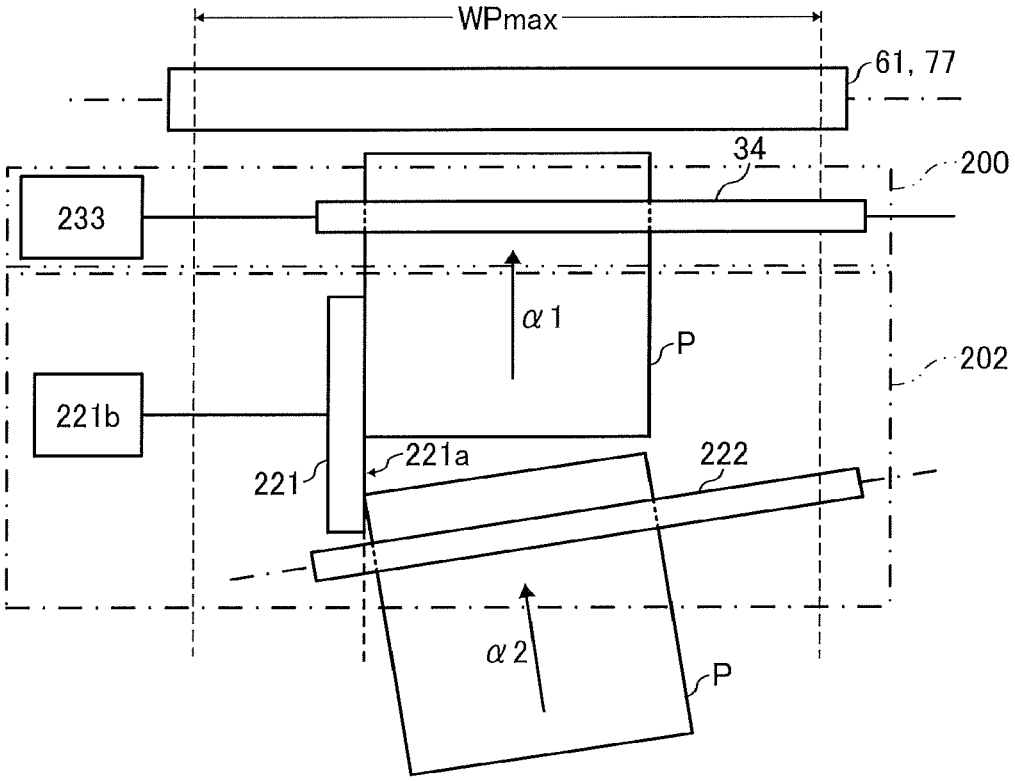
FIG. 6 is a schematic plan view illustrating a sheet shifting device, an angular displacement correcting mechanism and a secondary transfer nip region.

FIG. 6 is a schematic plan view illustrating the sheet shifting device 200, an angular displacement correcting mechanism 202 and the secondary transfer nip region. To be more specific, FIG. 6 is a schematic plan view illustrating the sheet shifting device 200, the angular displacement correcting mechanism 202 that is located upstream from the sheet shifting device 200 in the sheet conveying direction of the sheet P, and the secondary transfer nip region located downstream from the sheet shifting device 200 in the sheet conveying direction of the sheet P.

The secondary transfer nip region is defined by the intermediate transfer belt 61 and the secondary transfer belt 77.

The angular displacement correcting mechanism 202 corrects angular displacement of the sheet P conveyed through the pre-transfer sheet conveyance passage 31 before the sheet P enters the sheet shifting device 200. At the same time, the angular displacement correcting mechanism 202 aligns the sheet P (i.e., performs a lateral registration of the sheet P) in the width direction (i.e., the direction β) perpendicular to a sheet feeding direction (i.e., the direction α).

"WP max" in FIG. 6 represents the maximum sheet feed width of the sheet P that can be fed to the image forming apparatus 100. The angular displacement correcting mechanism 202 includes an alignment plate 221 and a pair of angular feed rollers 222. The alignment plate 221 contacts one end face (i.e., the left side end face) of the sheet P in the width direction. The pair of angular feed rollers 222 includes a pair of sheet conveying rollers (i.e., an upper sheet conveying roller and a lower sheet conveying roller). The alignment plate 221 is disposed such that the center in the width direction of the sheet P after laterally aligned is located at the center of the maximum sheet feed width "WP max". A regulating face 221*a* is an inner face of the alignment plate 221 in the width direction to contact the end face of the sheet P and regulate the position of the sheet P. The regulating face 221*a* is a parallel surface to the sheet feeding direction (i.e., a direction α1). The alignment plate 221 is movable (that is, position adjustable) in the width direction β by an alignment plate shifting mechanism 221*b* including a stepping motor that is controlled by the controller 400.

The pair of angular feed rollers 222 is disposed upstream from the alignment plate 221 in the sheet feeding direction (i.e., the direction α1). The angular displacement correcting mechanism 202 includes an angular feed roller pair driving mechanism to drive and rotate the pair of angular feed rollers 222. The angular displacement correcting mechanism 202 includes an angular feed roller pair contact and separation mechanism to change the states of the two rollers (i.e., an upper roller and a lower roller) of the pair of angular feed rollers 222 between a contact state in which the two rollers of the pair of angular feed rollers 222 are in contact with each other with a predetermined nip pressure and a separation state in which the two rollers of the pair of angular feed rollers 222 are separated from each other. The angular feed roller pair driving mechanism and the angular feed roller pair contact and separation mechanism are controlled by the controller 400.

The pair of angular feed rollers 222 is disposed with the rotational axis thereof at an angle to the sheet feeding direction (i.e., the direction α1) such that the sheet P being conveyed through the pre-transfer sheet conveyance passage 31 is held and conveyed toward the regulating face 221*a* of the alignment plate 221. According to this configuration, the sheet P is conveyed by the pair of angular feed rollers 222 at a certain angle in a direction indicated by arrow "α2" toward the alignment plate 221. The nip pressure of the pair of angular feed rollers 222 is set to be relatively smaller such that the sheet P being conveyed while being held by the pair of angular feed rollers 222 can slip on the surface of the pair of angular feed rollers 222. Therefore, even when the sheet P is conveyed from the pre-transfer sheet conveyance passage 31 at a certain angle, the sheet P moves while rotating along the regulating face 221*a* of the alignment plate 221, so as to correct the angular displacement of the sheet P. Further, the sheet P is aligned in the width direction.

Figure 7:
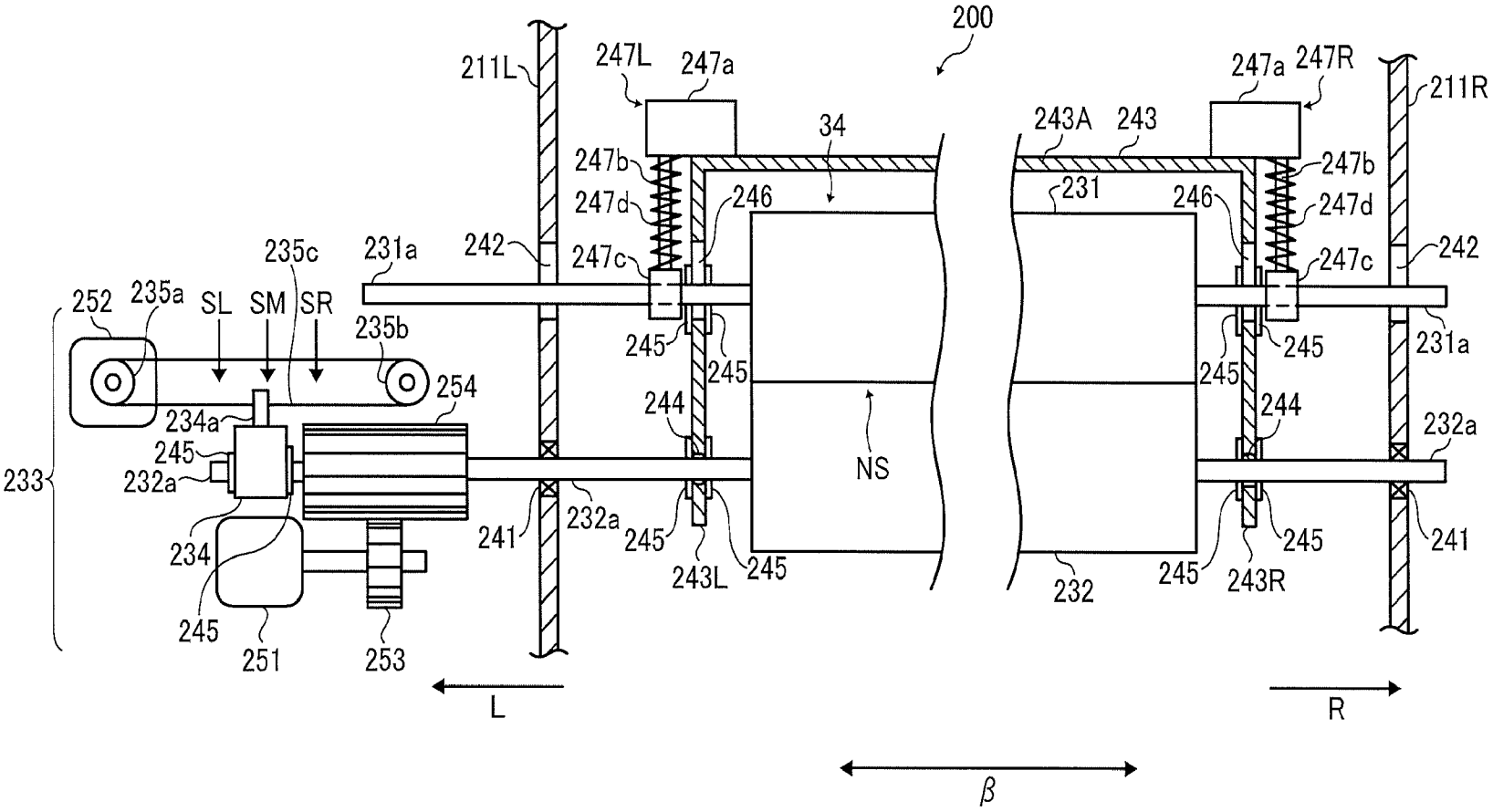
FIG. 7 is a diagram illustrating the sheet shifting device.

After having been corrected by the angular displacement correcting mechanism 202 and aligned in the width direction, the sheet P reaches to be held in a nip region of the pair of registration rollers 34 of the sheet shifting device 200 (i.e., a shifting roller nip region NS in FIG. 7).

The controller 400 controls the angular feed roller pair contact and separation mechanism to separate the upper and lower rollers of the pair of angular feed rollers 222 at a time at which the leading end of the sheet P reaches to be held by the pair of registration rollers 34.

The time at which the leading end of the sheet P is held by the pair of registration rollers 34 is calculated by the conveying speed and size (i.e., the dimension in the sheet conveying direction) of the sheet P.

Alternatively, a sensor may be disposed to detect that the leading end of the sheet P is held by the pair of registration rollers 34. In this configuration, the controller 400 controls the angular feed roller pair contact and separation mechanism based on a sheet detection signal that is input by the sensor to separate the upper and lower rollers of the pair of angular feed rollers 222.

Due to separation of the two rollers of the pair of angular feed rollers 222, the sheet P is released from the pair of angular feed rollers 222. Accordingly, it is prevented that a movement of the sheet P in the width direction β in the sheet shifting device 200 that is disposed downstream from the pair of angular feed rollers 222 in the sheet feeding direction α is hindered by the pair of angular feed rollers 222.

The sheet shifting device 200 is disposed upstream from the secondary transfer nip region in the sheet feeding direction and receives the sheet P after the angular displacement correcting mechanism 202 has corrected the angular displacement and aligned in the width direction. Consequently, in a case in which the width of the sheet P is smaller than the maximum sheet feed width "WP max", the sheet P is moved in the width direction and, at the same time, is conveyed toward the secondary transfer nip region. At this time, the sheet P is moved in the width direction such that the lateral position of the toner image formed on the surface of the intermediate transfer belt 61 and the lateral position of the sheet P match. That is, the sheet P to be conveyed toward the secondary transfer nip region is moved in the width direction β according to the passing position of the set sheet P.

FIG. 7 is a side view illustrating the sheet shifting device 200 included in the image forming apparatus 100 of FIG. 1.

The sheet shifting device 200 includes the pair of registration rollers 34. The two rollers of the pair of registration rollers 34 has respective rotary shafts disposed in parallel to the width direction of the sheet P. The two rollers of the pair of registration rollers 34 are an upper shift roller 231 and a lower shift roller 232 disposed to be vertical to each other and in parallel to the respective rotary shafts.

The rotary shaft of the lower shift roller 232 is a lower shift rotary shaft 232*a*. Both ends of the lower shift rotary shaft 232*a* in a left-to-right direction (i.e., a horizontal direction) are rotatably supported by two apparatus frame plates 211 (i.e., a left apparatus frame plate 211L and a right apparatus frame plate 211R) via respective bearings 241. The apparatus frame plates 211 (i.e., the left apparatus frame plate 211L and the right apparatus frame plate 211R) are part of an apparatus body of the image forming apparatus 100. Further, the lower shift rotary shaft 232*a* is supported by the apparatus frame plates 211 (i.e., the left apparatus frame plate 211L and the right apparatus frame plate 211R) to be slidable in a thrust direction (i.e., an axial direction) thereof.

The rotary shaft of the upper shift roller 231 is an upper shift rotary shaft 231*a*. Both ends of the upper shift rotary shaft 231*a* in the left-to-right direction (i.e., the horizontal direction) are rotatably supported by the two apparatus frame plates 211 (i.e., the left apparatus frame plate 211L and the right apparatus frame plate 211R) while being inserted into a frame slot 242 that is extended in a vertical direction of the image forming apparatus 100. Further, the upper shift rotary shaft 231*a* is supported by the apparatus frame plates 211 (i.e., the left apparatus frame plate 211L and the right apparatus frame plate 211R) to be slidable in the vertical direction along a longitudinal direction of the frame slot 242.

The upper shift roller 231 and the lower shift roller 232 are coupled by a coupling frame 243 between the apparatus frame plates 211 (i.e., the left apparatus frame plate 211L and the right apparatus frame plate 211R). The coupling frame 243 includes an upper side plate portion 243A that extends in the left-to right direction (i.e., the horizontal direction). Both end portions of the upper side plate portion 243A are bent downwardly by an angle of 90 degrees, which are a left leg plate portion 243L and a right leg plate portion 243R. The lower shift rotary shaft 232*a* on the left side of the lower shift roller 232 is rotatably inserted into a round hole 244 formed in the left leg plate portion 243L and, at the same time, is prevented from moving in the thrust direction toward the left leg plate portion 243L. The lower shift rotary shaft 232*a* on the right side in FIG. 7 is rotatably inserted into a different round hole 244 formed in the right leg plate portion 243R and, at the same time, is restrained to move right side is rotatably inserted into the round hole 244 formed in the right leg plate portion 243R and, at the same time, is prevented from moving in the thrust direction toward the right leg plate portion 243R.

The upper shift rotary shaft 231*a* on the left side of the upper shift roller 231 is rotatably inserted into a longitudinal leg portion slot 246 formed in the left leg plate portion 243L in the vertical direction and, at the same time, is slidably inserted in the vertical direction along the leg portion slot 246. Further, the upper shift rotary shaft 231*a* is prevented to move in the thrust direction to the left leg plate portion 243L by the retaining ring 245.

The upper shift rotary shaft 231*a* on the right side in FIG. 7 is rotatably inserted into the leg portion slot 246 formed in the right leg plate portion 243R and, at the same time, is slidably inserted in the vertical direction along the leg portion slot 246. Further, the upper shift rotary shaft 231*a* is prevented to move in the thrust direction to the right leg plate portion 243R by the retaining ring 245.

Respective shift roller contact and separation mechanisms 247 (i.e., 247L and 247R) are disposed at both ends (i.e., the left and right ends) of the coupling frame 243. The shift roller contact and separation mechanisms 247 (i.e., 247L and 247R) cause the upper shift roller 231 to contact to and separate from the lower shift roller 232. The shift roller contact and separation mechanisms 247 (i.e., 247L and 247R) are electromagnetic solenoid plungers.

Specifically, left and right solenoids 247*a* are fixedly disposed at both ends (the left and right ends) of the coupling frame 243. Left and right plungers 247*b* of the left and right solenoids 247*a* at both ends are disposed downwardly. Respective upper roller bearings 247*c* are mounted on the left and right plungers 247*b* at the lower ends of the shift roller contact and separation mechanisms 247 (i.e., 247L and 247R).

The upper shift rotary shaft 231*a* on the left side of the upper shift roller 231 is rotatably inserted into the upper roller bearings 247*c* on the left side in FIG. 7. Further, the upper roller bearings 247*c* on the right side of the upper shift roller 231 is rotatably inserted into the upper roller bearings 247*c* on the right side in FIG. 7.

Further, respective coil springs 247*d* that function as respective biasing bodies are fitted around the outside of the left and right plungers 247*b*. The coil springs 247*d* are provided in a contracted state between the left and right solenoids 247*a* and the respective upper roller bearings 247*c*. The left and right solenoids 247*a* on the left and right sides are energized by an ON-OFF control by the controller 400.

When the power to the left and right solenoids 247*a* is not energized (the power is off), the left and right plungers 247*b* are pushed down due to respective strut forces. At this time, the left and right plungers 247*b* are pulled down until the upper shift roller 231 contacts the lower shift roller 232 to be received. By so doing, the upper shift roller 231 is held by the lower shift roller 232 in a contact state in which the upper shift roller 231 contacts the lower shift roller 232 with a predetermined pressing force due to the strut forces of the coil springs 247*d*. At this time, the shifting roller nip region NS is formed between the upper shift roller 231 and the lower shift roller 232 to hold and convey the sheet P.

Figure 9:
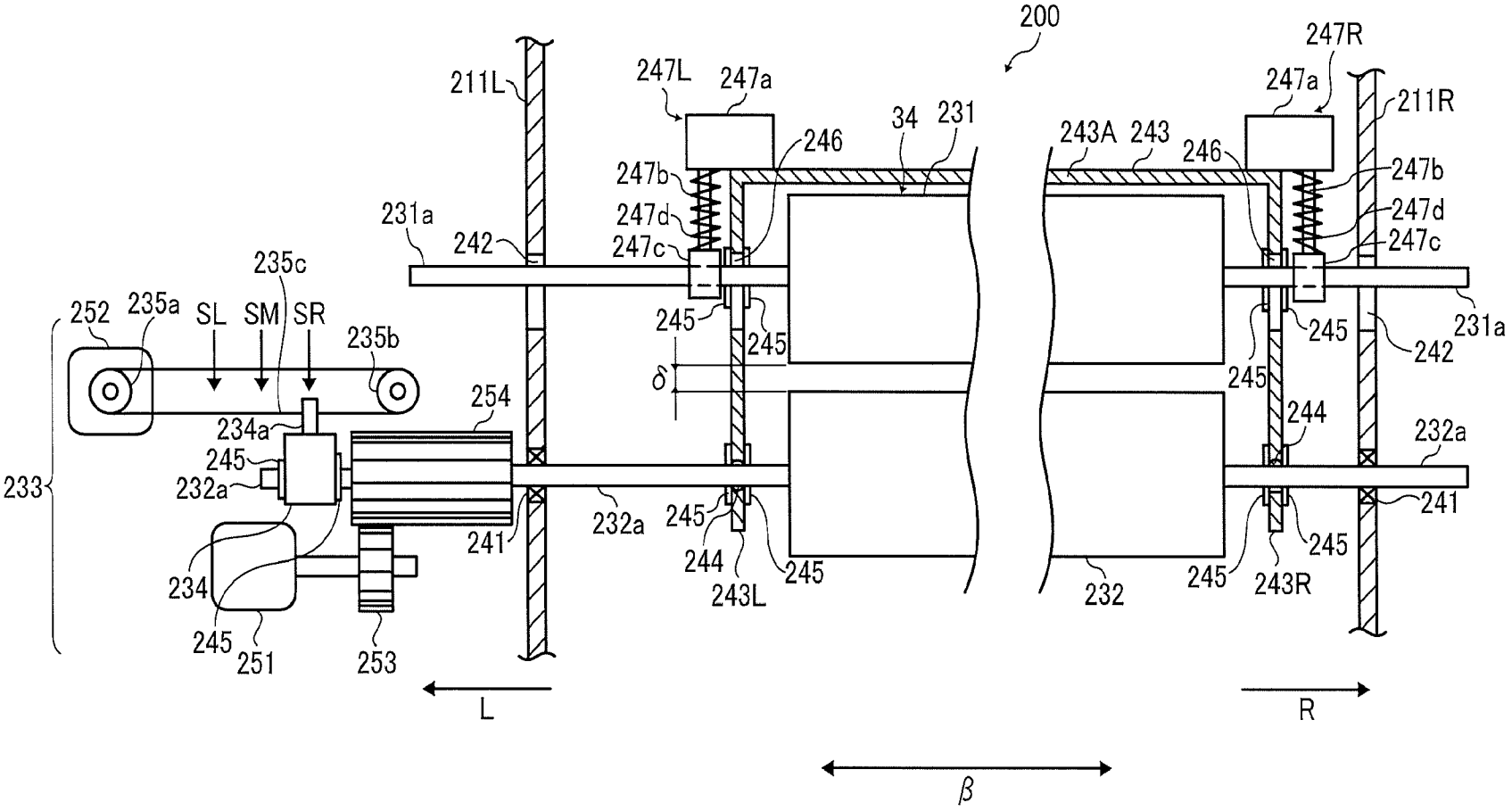
FIG. 9 is a diagram illustrating the sheet shifting device with rollers of a pair of shift rollers separated apart from each other.

By contrast, when the power to the left and right solenoids 247*a* is energized (the power is on), the left and right plungers 247*b* are pulled up against the strut forces of the coil springs 247*d* due to respective magnetic forces of the left and right solenoids 247*a*. By so doing, the upper shift roller 231 is moved to be pulled up by the predetermined amount from the lower shift roller 232 and is held by the lower shift roller 232 in a separated state in which a gap (δ) is formed as illustrated in FIG. 9. That is, the shifting roller nip region NS formed between the upper shift roller 231 and the lower shift roller 232 is released.

A shift roller drive device 233 is disposed outside the sheet shifting device 200, on the left side of the lower shift roller 232 in FIG. 7. The shift roller drive device 233 has a function to rotate the lower shift roller 232 and a function to shift (move) the upper shift roller 231 and the lower shift roller 232 in the width direction (i.e., a direction indicated by arrow β).

Further, as illustrated in FIG. 7, in the sheet shifting device 200 according to the present embodiment, the shift roller drive device 233 is disposed outside the left apparatus frame plate 211L. To be more specific, the left side end of the lower shift rotary shaft 232*a* of the lower shift roller 232 in FIG. 7 is projected to the outside of the left apparatus frame plate 211L from the bearing 241. A wide gear 254 that extends in the width direction (i.e., the direction β) is fixedly disposed on the lower shift rotary shaft 232*a* projected outwardly. As illustrated in FIG. 7, a shift roller rotation drive gear 253 is meshed with the wide gear 254. The shift roller rotation drive gear 253 output a rotation driving force of a shift roller rotation drive motor 251 (a stepping motor) to the wide gear 254. The shift roller rotation drive motor 251 is fixed to the frame (the apparatus body) of the image forming apparatus 100.

The shift roller rotation drive motor 251 is controlled by the controller 400 with the ON-OFF control. As the shift roller rotation drive motor 251 is driven and rotated, a rotation driving force generated by the shift roller rotation drive motor 251 is transmitted to the lower shift rotary shaft 232*a* via the shift roller rotation drive gear 253 and the wide gear 254. Accordingly, the lower shift roller 232 is driven and rotated in the sheet feeding direction of the sheet P. As long as the upper shift roller 231 is in contact with the lower shift roller 232, the upper shift roller 231 is rotated along with rotation of the lower shift roller 232. That is, by driving the shift roller rotation drive motor 251, the upper shift roller 231 and the lower shift roller 232 rotate in the sheet feeding direction (i.e., the direction α) to feed (convey) the sheet P. When the upper shift roller 231 is separated from the lower shift roller 232 (in the state illustrated in FIG. 9), the upper shift roller 231 does not rotate.

In addition, a shift transmission bearing 234 is disposed further away from the wide gear 254 on the left side of the lower shift rotary shaft 232*a*. The shift transmission bearing 234 is restricted by the retaining ring 245 not to move in the thrust direction to the lower shift rotary shaft 232*a*. Further, a shift drive pulley 235*a*, a shift motor 252 (a stepping motor) and a shift belt pulley 235*b* are disposed in the frame (the apparatus body) of the image forming apparatus 100. A shift belt 235*c* (a timing belt) is stretched with tension be the shift drive pulley 235*a* that is mounted on the shift motor 252 and the shift belt pulley 235*b*. A shift transmission bearing 234 is coupled, via the shift coupling portion 234*a*, to a belt portion forming a lower stretched surface of the shift belt 235*c*.

The shift motor 252 is controlled by the controller 400. When the sheet P is conveyed, the controller 400 executes a forward control to drive the shift motor 252 in a forward direction by a set number of control pulses and shift the sheet P to the right side. Then, after completion of conveyance of the sheet P, the controller 400 executes a reverse control to drive the shift motor 252 in a reverse direction by the same number of control pulses as the number of control pulses set in the forward control. By contrast, in a case in which the controller 400 executes the reverse control to drive the shift motor 252 in the reverse direction by the set number of control pulses and shift the sheet P to the left side when the sheet P is conveyed, the controller 400 executes the forward control to drive the shift motor 252 in the forward direction by the same number of control pulses as the number of control pulses set in the reverse control.

When the shift motor 252 starts driving to shift the sheet P, the shift coupling portion 234*a* is located at a home position SM as illustrated in FIG. 7. Therefore, the coupling frame 243 including the upper shift roller 231 and the lower shift roller 232 is located at the center position that is the center between the left apparatus frame plate 211L and the right apparatus frame plate 211R, as illustrated in FIG. 7.

After the shift motor 252 has been rotated in the forward direction by the number of control pulses set in the forward control, as illustrated in FIG. 7, the shift belt 235*c* is rotated in the counterclockwise direction in FIG. 7. According to this rotation of the shift belt 235*c*, the shift coupling portion 234*a* that is fixed to the shift belt 235*c* moves from the home position SM by a set shift amount in the right direction in FIG. 7 and stops at a right stop position SR.

Figure 8:
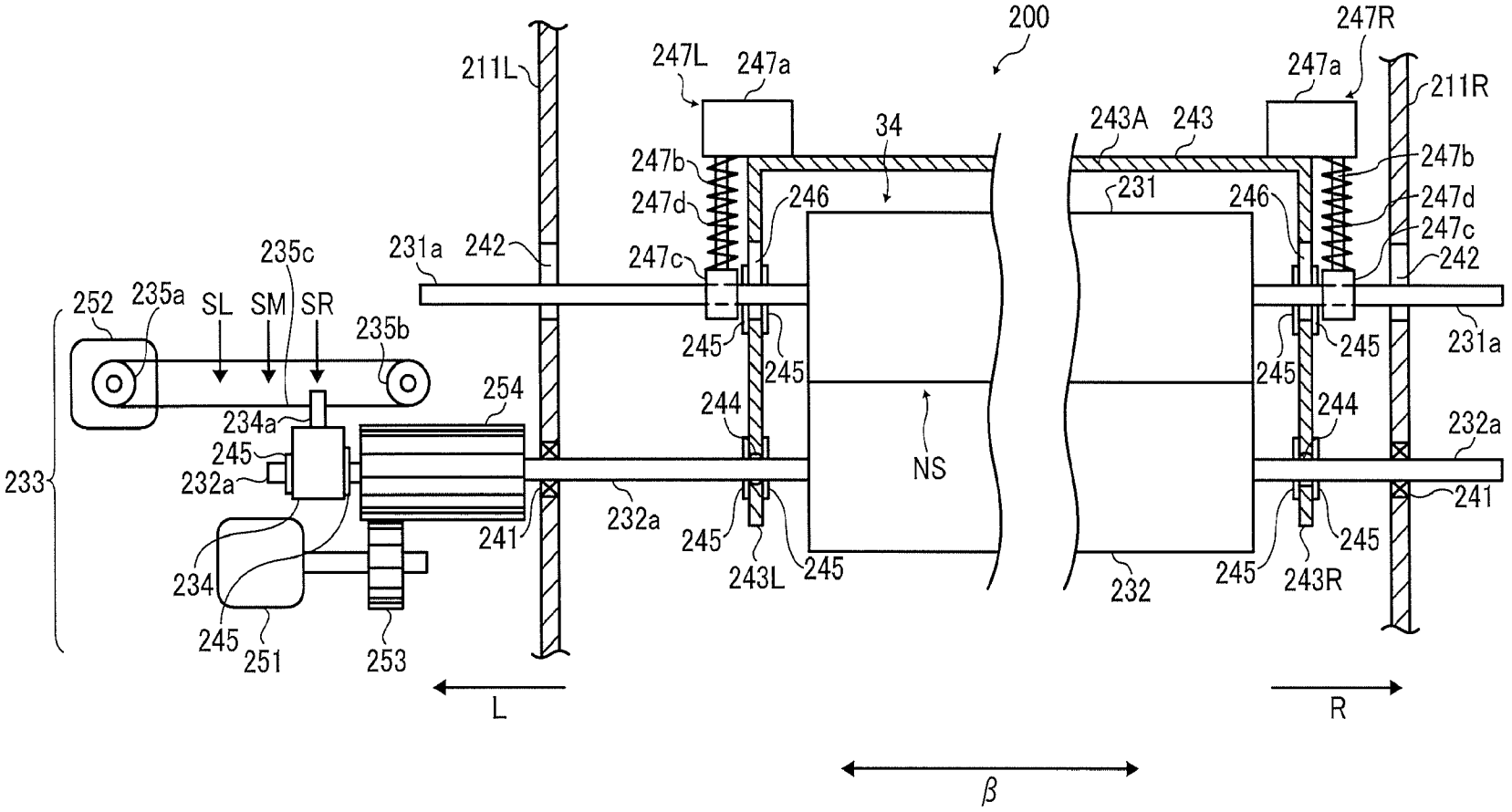
FIG. 8 is a diagram illustrating the sheet shifting device with a coupling frame located at a right-aligned position.

Along with this movement of the shift coupling portion 234*a*, the lower shift rotary shaft 232*a* that is fixed in the thrust direction to the shift transmission bearing 234 including the shift coupling portion 234*a* slides to the right side. Therefore, the coupling frame 243 including the upper shift roller 231 and the lower shift roller 232 moves to the right side from the center position that is the center between the left apparatus frame plate 211L and the right apparatus frame plate 211R, as illustrated in FIG. 7. Then, the coupling frame 243 moves toward a right-aligned position between the left apparatus frame plate 211L and the right apparatus frame plate 211R (i.e., the position in FIG. 8) by the set shift amount.

When the coupling frame 243 is shifted to the right side by the set shift amount and the sheet P that is conveyed by the lower shift roller 232 and the upper shift roller 231 reaches the secondary transfer nip region, the power to the left and right solenoids 247*a* is turned on (energized). By so doing, the upper shift roller 231 is moved to be pulled up by the predetermined amount from the lower shift roller 232 and is held by the lower shift roller 232 in the separated state in which the gap (δ) is formed as illustrated in FIG. 9.

After the upper shift roller 231 is separated from the lower shift roller 232 to move into the separated state, the shift motor 252 is rotated in the reverse direction by the same predetermined number of control pulses as the number of control pulses in the forward control while the left and right solenoids 247*a* are being energized. By so doing, the shift coupling portion 234*a* moves from the right stop position SR toward the home position SM. According to this movement of the shift coupling portion 234*a*, the coupling frame 243 in the separated state in which the upper shift roller 231 and the lower shift roller 232 are separated from each other is moved to the center position between the left apparatus frame plate 211L and the right apparatus frame plate 211R.

As described above, the shift motor 252 is rotated in the forward direction by the set number of control pulses and then in the reverse direction by the same number of control pulses as the set number of control pulses in the forward control. By so doing, the upper shift roller 231 and the lower shift roller 232 perform a reciprocating motion (a shift motion) in the width direction (i.e., the direction β). When the shift coupling portion 234*a* is returned to the home position SM and the coupling frame 243 is returned to the center position between the left apparatus frame plate 211L and the right apparatus frame plate 211R, the power to the left and right solenoids 247*a* is turned off to cause the upper shift roller 231 and the lower shift roller 232 to contact to each other.

The controller 400 executes the following controls to the sheet shifting device 200. The controller 400 generally causes the shift coupling portion 234*a* to be located at the home position SM. By so doing, the coupling frame 243 including the upper shift roller 231 and the lower shift roller 232 comes to be located at the center position between the left apparatus frame plate 211L and the right apparatus frame plate 211R, as illustrated in FIG. 7. In this condition, the controller 400 causes the power to the left and right solenoids 247*a* to be turned off. Accordingly, the upper shift roller 231 is in the contact state in which the upper shift roller 231 is in contact with the lower shift roller 232.

The controller 400 turns on the shift roller rotation drive motor 251 based on a sheet feeding start signal. By so doing, the upper shift roller 231 and the lower shift roller 232 are driven and rotated in the sheet conveying direction of the sheet P. In this condition, the leading end of the sheet P that is conveyed along the regulating face 221*a* of the alignment plate 221 from the angular displacement correcting mechanism 202 reaches the shifting roller nip region NS formed by the upper shift roller 231 and the lower shift roller 232 and is held by the upper shift roller 231 and the lower shift roller 232. The controller 400 detects that the leading end of the sheet P has reached the shifting roller nip region NS and been held thereby, for example, as follows.

Specifically, the controller 400 detects the leading end of the sheet P at the shifting roller nip region NS by calculating based on a sheet feeding start time of the sheet P from a selected sheet feed tray (i.e., either one of the first sheet container 101 and the second sheet container 102), the sheet conveying speed of the sheet P and the length of the sheet conveyance passage of the sheet P from the selected sheet feed tray (i.e., either one of the first sheet container 101 and the second sheet container 102) to the shifting roller nip region NS.

As another detecting method, a sheet sensor may be disposed downstream from the shifting roller nip region NS in the sheet conveying direction to perform the detection.

The controller 400 causes the two rollers of the pair of angular feed rollers 222 on the side of the angular displacement correcting mechanism 202 to be separated from each other, based on a detection signal that has detected that the leading end of the sheet P. Due to separation of the two rollers of the pair of angular feed rollers 222, the sheet P is released from the pair of angular feed rollers 222.

When a sheet P having the width smaller than the maximum sheet feed width "WP max" is conveyed, the controller 400 causes the shift motor 252 of the sheet shifting device 200 to rotate by the set number of control pulses in one of the forward direction and the reverse direction, based on the above-described detection signal. When the shift motor 252 is rotated in the forward direction, the coupling frame 243 moves from the center position illustrated in FIG. 7 to a right side direction R toward the right-aligned position. At this time, the sheet P that is held by the upper shift roller 231 and the lower shift roller 232 is conveyed in the sheet feeding direction (i.e., the direction α) and, at the same time, is moved (shifted) to the right side direction R along the width direction (i.e., the direction β).

Then, the controller 400 turns on the power to the left and right solenoids 247*a* at the same time when the leading end of the sheet P that is conveyed in the sheet feeding direction reaches the secondary transfer nip region while being held by the upper shift roller 231 and the lower shift roller 232. By so doing, the upper shift roller 231 is pulled up to be separated from the lower shift roller 232, as illustrated in FIG. 9, and therefore the sheet P that has been held by the upper shift roller 231 and the lower shift roller 232 is released from the upper shift roller 231 and the lower shift roller 232. At this time, the sheet P is continuously conveyed while being held in the secondary transfer nip region.

The controller 400 detects that the leading end of the sheet P has reached the secondary transfer nip region and been held therein, for example, as follows.

That is, the controller 400 detects that the leading end of the sheet P reaches the shifting roller nip region NS and is held therein. Then, the controller 400 detects the leading end of the sheet P at the shifting roller nip region NS by calculating based on the sheet conveying speed of the sheet P by the upper shift roller 231 and the lower shift roller 232 and the length of the sheet conveyance passage between the shifting roller nip region NS and the secondary transfer nip region.

As another detecting method, a sheet sensor may be disposed downstream from the secondary transfer nip region in the sheet conveying direction to perform the detection.

The controller 400 separates the upper shift roller 231 from the lower shift roller 232, and then causes the shift motor 252 of the sheet shifting device 200 to drive and rotate in reverse by the same number of control pulses as the number of control pulses rotated in the forward control. By so doing, the coupling frame 243 that includes the upper shift roller 231 and the lower shift roller 232 held while being separated from each other moves from the right-aligned position to a left side direction L illustrated in FIGS. 8 and 9, so as to return to the center position as illustrated in FIG. 7.

Thereafter, the controller 400 detects, based on calculation or the sheet sensor, that the trailing end of the sheet P being conveyed in the secondary transfer nip region has passed the position of the two rollers of the pair of angular feed rollers 222 in the separated state, which is included in the angular displacement correcting mechanism 202. Based on the detection signal, the controller 400 causes the two rollers of the pair of angular feed rollers 222 to change from the separated state to the contact state.

Next, the controller 400 detects, based on calculation or the sheet sensor, that the trailing end of the sheet P has passed the upper shift roller 231 and the lower shift roller 232 in the separated state. Based on the detection signal, the controller 400 causes the power to the left and right solenoids 247*a* to turn off. Accordingly, the upper shift roller 231 and the lower shift roller 232 are changed from the separated state to the contact state. The sheet shifting device 200 waits in this state for the subsequent sheet P to come from the angular displacement correcting mechanism 202.

When the sheet P is shifted to the left, the shift motor 252 of the sheet shifting device 200 is driven and rotated in reverse by the set number of control pulses based on the detection signal detecting that the leading end of the sheet P has reached and been held in the shifting roller nip region NS. By so doing, the shift coupling portion 234*a* moves from the home position SM illustrated in FIG. 7 by the shift amount set in the left direction in FIG. 7 and stops at a left end position SL. Consequently, the coupling frame 243 moves from the center position to the left side direction L in FIG. 7. Then, the sheet P held by the upper shift roller 231 and the lower shift roller 232 is moved (shifted) to the left side direction L along the width direction (i.e., the direction β) while being conveyed in the sheet feeding direction (i.e., the direction α).

Thereafter, when the sheet P that has been shifted to the left side is detected at the secondary transfer nip region, the controller 400 causes the power to the left and right solenoids 247*a* to turn on (energize) to separate the upper shift roller 231 and the lower shift roller 232 from each other. Then, the controller 400 causes the shift motor 252 of the sheet shifting device 200 to drive and rotate in the forward direction by the same number of control pulses as the number of control pulses rotated in the reverse control.

By so doing, the coupling frame 243 that includes the upper shift roller 231 and the lower shift roller 232 held while being separated from each other moves from a left-aligned position to the right side direction R, so as to return to the center position as illustrated in FIG. 7.

By sifting the sheet P to the width direction that is a direction perpendicular to the sheet conveying direction, the sliding traces formed on the surface of the fixing belt 41 due to the burrs at both lateral ends of the sheet P can be dispersed.

In the image forming apparatus 100 according to the present embodiment, each time a predetermined amount of sheets P is passed, the setting of the passing position of the sheet P in the width direction is controlled and changed.

Each time the predetermined amount of sheets P is passed, the controller 400 changes the setting of the passing position of the sheet P in the width direction. After the setting of the passing position of the sheet P has been changed, when the sheet P arrives the pair of registration rollers 34, the controller 400 controls the sheet shifting device 200 so that the pair of registration rollers 34 shifts in the width direction until the pair of registration rollers 34 reaches the set passing position. By so doing, the position in the width direction of the sheet P being held by the pair of registration rollers 34 is determined as the set passing position.

Hereinafter, the control to change the setting of the passing position of the sheet P in the width direction is also referred to as an "edge shifting."

The controller 400 changes the setting of the number of sheets P on which an image is to be formed to trigger the edge shifting based on parameters indicating characteristics of the sheet P, such as type, basis weight, brand, and thickness. These parameters are input via a control panel 300.

Even when the edge shifting is not performed, the sliding traces on the fixing belt 41 generated by contacting with both lateral ends of the sheet P are formed in a range in the width direction from 0.3 mm to 0.7 mm.

Without being affected by whether a shifting mechanism such as the sheet shifting device 200 is installed or not, a sheet such as the sheet P cannot be conveyed with an error of 0 mm in the accuracy of the position in the width direction. Even though the position in the width direction is adjusted by a shifting mechanism, the passing position in the width direction of the sheet P that has passed the shifting mechanism varies in a range ±0.1 mm. Further, after the sheet P has passed the shifting mechanism, the sheet P is conveyed to pass the secondary transfer nip region and reach the fixing nip region. Therefore, the position in the width direction of the sheet passing the fixing nip region further varies. Accordingly, the position of a fixing body that contacts the lateral ends of the sheet P varies in the width direction.

In the image forming apparatus 100 according to the present embodiment, in a case in which the edge shifting is not performed by the sheet shifting device 200, the sliding traces formed on the surface of the fixing belt 41 are formed in a range in the width direction from 0.3 mm to 0.7 mm.

By contrast, by shifting the passing position of the sheet P in the width direction by the sheet shifting device 200 periodically, the sliding traces formed on the surface of the fixing belt 41 can be dispersed in the width direction. Specifically, by shifting the passing position of the sheet P in the width direction in a range of ±1.35 mm (the width to shift: 2.7 mm), the sliding traces formed on the surface of the fixing belt 41 are dispersed in a range from 2.7 mm to 3.3 mm (the width to shift: 3.0±0.3 mm). By increasing the sliding traces formed on the surface of the fixing belt 41 in the range from 2.7 mm to 3.3 mm, by pressing the refresh roller 46 against the fixing roller 42 via the fixing belt 41, the edge scratches formed on the surface of the fixing belt 41 caused by contacting the lateral ends of the sheet P can be prevented.

Now, a description is given of a comparative image forming apparatus.

In general, various types of image forming apparatuses are provided with a fixing device that includes a fixing roller having an infrared heater as a device to fix a toner image transferred onto a sheet-like recording medium and a pressure roller to press the fixing roller. Such a fixing device is widely known to employ a heat roller fixing method in which a sheet having an unfixed toner image thereon is heated and pressed in a fixing nip region formed by the fixing roller and the pressure roller while the sheet is being held and conveyed by the fixing roller and the pressure roller.

A belt fixing method is also known as another method to be employed to a fixing device. The belt fixing method is a method in which a fixing belt having an endless loop is stretched by a pressure roller having an infrared heater therein and a fixing roller and a sheet is held and conveyed in a fixing nip region formed by the fixing belt and the pressure roller. In this fixing method, while holding and conveying the sheet having an unfixed toner image thereon in a fixing nip region formed by the fixing belt and the pressure roller to press a fixing roller via the fixing belt, the pressure roller and the fixing belt apply heat and pressure to the sheet. A surface layer material for a fixing belt is known to include PFA (polytetrafluoroethylene) that is good in release property with toner.

In known fixing devices, as sheets are conveyed, edge scratches are generated on the surface of a fixing body due to sheet conveyance (sheet feeding), therefore gloss streaks are generated on an image formed on a sheet. A major cause of edge scratches on the fixing body is burrs at both lateral ends of each sheet generated when the sheet is cut. Specifically, as multiple sheets having the same size are sequentially fed, the surface of the fixing body becomes rough and scratched at respective parts of the fixing body to contact both lateral ends of the sheet, that is, at respective parts to contact burrs of the sheet.

A comparative fixing device includes a recovery member and a shifting mechanism. The recovery member slides on a fixing body and making the fixing body uniform on the surface to restrain occurrence of abnormal images having gloss streaks. The shifting mechanism shifts the passing position of the sheet. However, in the configuration of the comparative fixing device, the shifting mechanism shifts the passing position of the sheet each time a certain number of sheets passes, without depending on the characteristics of the sheet such as sheet type. For this reason, in a case in which sheets having high burrs at both lateral ends thereof are fed, it was likely that edge scratches having a certain depth were formed in the fixing body before the certain number of sheets passes and the shifting of the passing position of the sheet performed each time a certain number of sheets passes, and that defect images such as an image with gloss streaks thereon were generated when the image was output. Further, with the edge scratches having a certain depth, even if the recovery member slides on the fixing body, the edge scratches formed on the fixing body could not be removed.

Further, with the edge scratches having a certain depth, even if the recovery member slides on the fixing body, the edge scratches formed on the fixing body could not be removed. According to this configuration, the number of sheets to be fed before the edge shifting is properly controlled, the edge scratches formed on the surface of the fixing belt 41 is prevented from increasing beyond the certain depth, and the edge scratches can be repaired by causing the refresh roller 46 to slide on the surface of the fixing belt 41.

The configuration to which parameters indicating the characteristics of the sheet P are inputted is not limited to the configuration to which the parameters are inputted via the control panel 300. For example, this disclosure is applicable to a configuration to which the parameters are inputted from an external device such as a personal computer. This disclosure is also applicable to a configuration to which parameters indicating the characteristics of the sheet P to be set in the first sheet container 101 or the second sheet container 102 are inputted via the control panel 300 or the external device. In this configuration, when a print job is performed, the sheet feeding tray from which the sheet P is fed is selected. Accordingly, the controller 400 acquires the parameters indicating the characteristics of the sheet P on which image formation is performed.

In the image forming apparatus 100 according to the present embodiment, the type, basis weight and size of the sheet P are used as parameters indicating the characteristics of the sheet P.

The following formula (1) is used to determine whether the edge shifting is performed or not.

$$\Sigma\,(\text{Length in the sheet feeding direction} \times \text{Coefficient } \gamma \text{ per sheet type and basis weight}) \geq \text{Threshold for edge shifting} \quad (1).$$

The controller 400 counts the length of the sheet P in the sheet feeding direction per size of the sheet P in the width direction, adds the coefficient γ to the length of the sheet P in the sheet feeding direction per the type and basis weight of the sheet P, and compares a value weighted and calculated (the left-side value in the formula (1)) with a threshold (the right-side value in the formula (1)).

When the value calculated per the size of the sheet P in the width direction is greater than or equal to the threshold value, the edge shifting is performed.

The shift amount in one edge shifting (the amount of movement of the cell position described below) is in a range from 0.08 mm to 0.09 mm. After the edge shifting is performed, the count of the length in the sheet feeding direction is reset.

At this time, the type and basis weight of the sheet P having high burr have a greater coefficient γ and reduce the number of sheets before the edge shifting, so that the edge scratches formed on the surface of the fixing belt 41 are set not to increase over the certain value.

Figure 10:
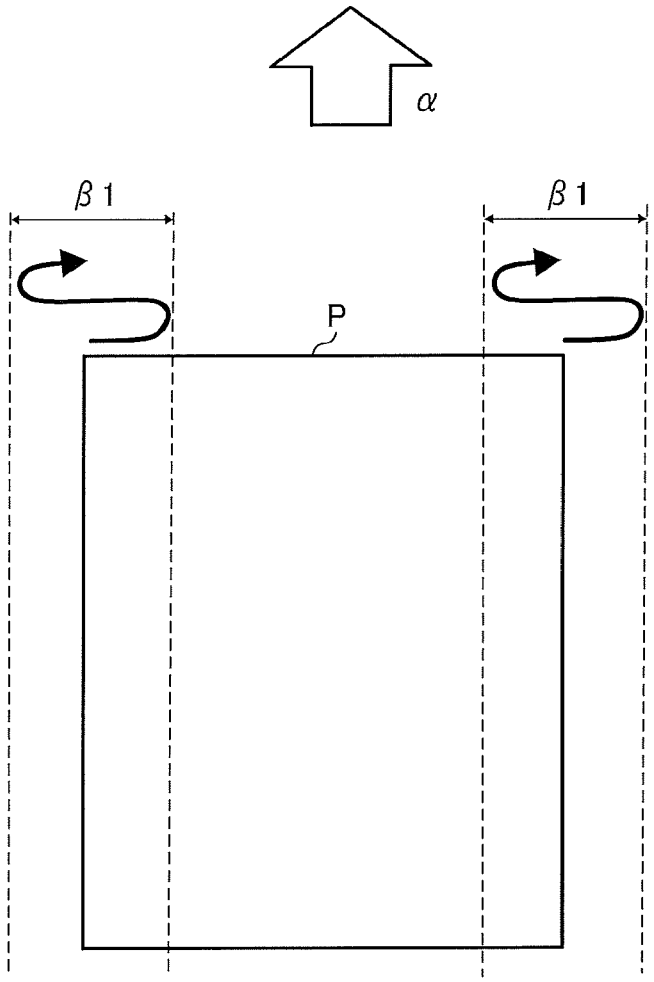
FIG. 10 is a diagram illustrating changes of a passing position of the sheet due to edge shifting.

FIG. 10 is a diagram illustrating changes of the passing position of the sheet P due to the edge shifting.

The sheet P in FIG. 10 indicates that the sheet P is at the reference position. From the reference position, the passing position of the sheet P shifts in both left and right directions (i.e., a direction perpendicular to the sheet conveying direction indicated by arrow α) in FIG. 10. In the edge shifting, after the passing position of the sheet P has shifted one direction along the left and right directions relative to the reference position and returned to the reference position, the passing position of the sheet P then shifts in the opposite direction relative to the reference position. In a case in which the sheet P is conveyed while the pair of registration rollers 34 of the sheet shifting device 200 remains at the home position, the passing position of the sheet P becomes the reference position. Then, as the pair of registration rollers 34 shifts to the left side and the right side, the passing position of the sheet P also shifts, accordingly.

In the configuration illustrated in FIG. 10, the passing position of the sheet P shifts to the right side in FIG. 10. After the passing position of the sheet P has reached the right side end of a shift width β1, the sheet P changes the shift direction to the left side direction. Then, after the passing position of the sheet P has returned to the reference position, the sheet P changes the shift direction to the left side in FIG. 10. After the passing position of the sheet P has reached the left side end of the shift width β1, the sheet P changes the shift direction to the reference position.

In the present embodiment, the shift width 131 is set in a range from 2.5 mm to 2.9 mm.

In the image forming apparatus 100 according to the present embodiment, after having shifted from the reference position to the right side end of the shift width β1 in FIG. 10 and then returned to pass the reference position, the passing position of the sheet P returns at the left side end of the shift width β1 and comes back to the reference position. This series of actions of the sheet P is determined as one cycle of the edge shifting. The passing position of the sheet P in one cycle is managed by 64 cell positions. When the 64 cells are moved, the passing position of the sheet P goes around and returns to the position at the start.

Figure 11A:
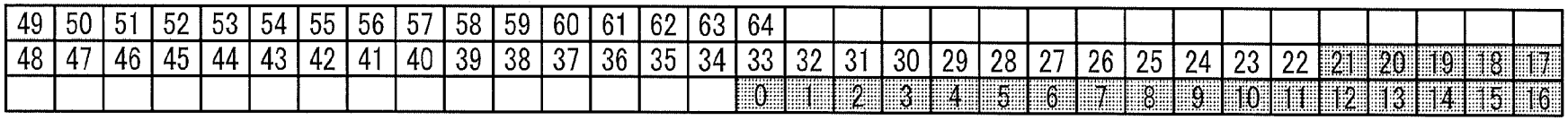
FIGS. 11A and 11B are diagrams illustrating the passing position of the sheet by one cycle of an edge shift including 64 cells.
Figure 11B:
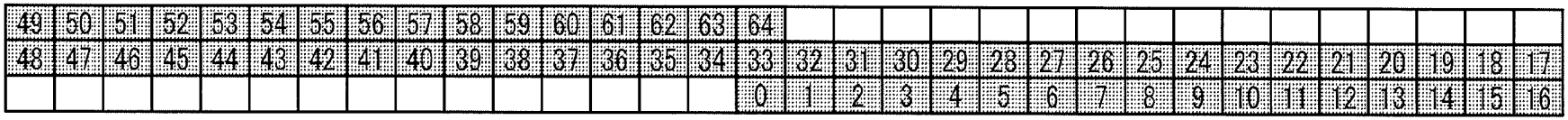

FIGS. 11A and 11B are diagrams illustrating the passing position of the sheet P by one cycle of the edge shift including 64 cells per one cycle.

Each time the number of sheets P starts to be fed from the reference position (cell 0) and reaches the predetermined number of fed sheets P to perform the edge shifting, the passing position of the sheet P is located at a position incremented by one (cell 1) from the reference position. Similarly, the passing position of the sheet P is shifted by one cell each time the predetermined number of sheets P passes. When the passing position of the sheet P is moved by 64 times, the sheet P reaches the reference position.

As illustrated in FIG. 11A, when the predetermined number of sheets P for the edge shifting is 46, the passing positions of the sheet P moved after 1,000 sheets have been fed (conveyed) are hatched in FIG. 11A, indicating the passing position of the sheet P has moved from cell 0 to cell 21. In a case in which the predetermined number of sheets P for the edge shifting is 46, the passing position of the sheet P goes one cycle of 64 cells after about 3,000 sheets (to be exact, 2,944 sheets) have been fed (conveyed).

As illustrated in FIG. 11B, when the predetermined number of sheets P for the edge shifting is 15, the passing positions of the sheet P moved after 1,000 sheets have been fed (conveyed) are hatched in FIG. 11B, indicating the passing position of the sheet P has moved from cell 0 to cell 64. In a case in which the predetermined number of sheets P for the edge shifting is 15, the passing position of the sheet P goes one cycle of 64 cells after about 1,000 sheets (to be exact, 960 sheets) have been fed (conveyed).

Figure 12A:
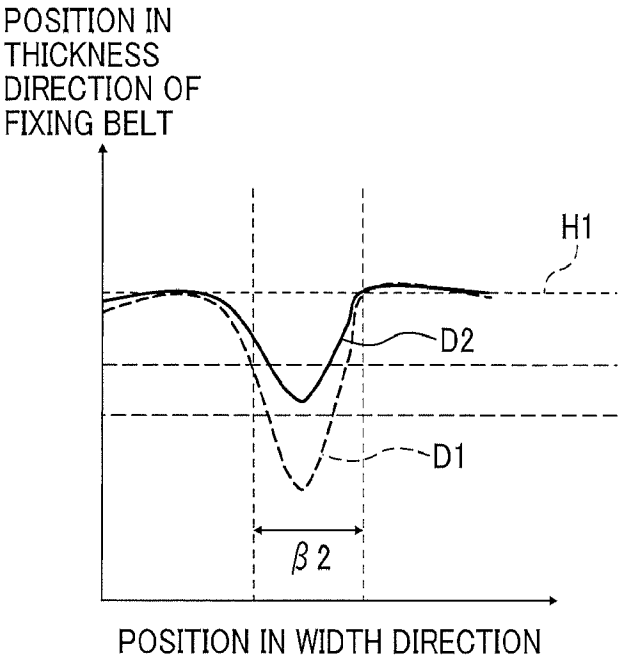
FIGS. 12A and 12B are graphs of test results of comparison of depths and widths of edge scratches generated on the fixing belt at different amounts of sheets.
Figure 12B:
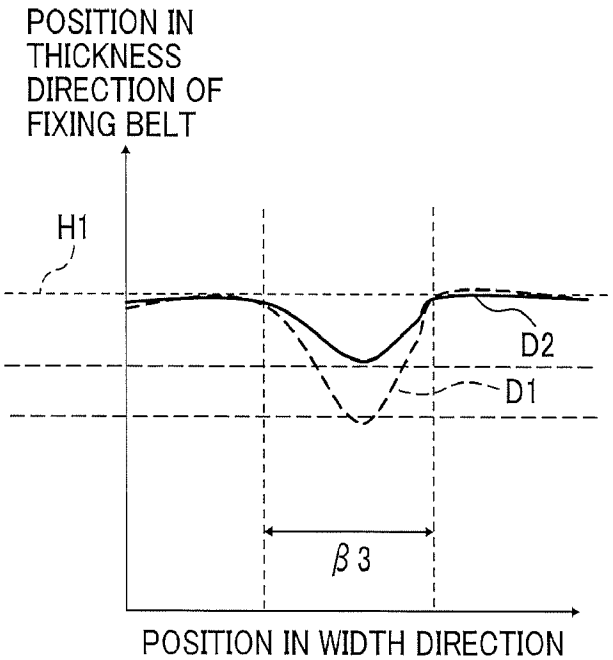

FIGS. 12A and 12B are graphs of test results of comparison of depths and widths of edge scratches generated on the surface of the fixing belt 41 at 46 sheets and 15 sheets. In the tests providing the results in FIGS. 12A and 12B, after 1,000 sheets have been fed from the initial state in the image forming apparatus 100 according to the present embodiment, the shapes of the cross section in the direction of the depth of the edge scratches (the thickness of the fixing belt 41) and the width direction of the edge scratches of the fixing belt 41 are measured. Thereafter, a recovery operation in which the refresh roller 46 is slid on the fixing belt 41 is performed for one time (for two minutes), and then the shapes of the cross section in the direction of the depth of the edge scratches (the thickness of the fixing belt 41) and the width direction of the edge scratches of the fixing belt 41 are measured again.

A broken straight line H1 in FIGS. 12A and 12B indicates a position of the surface of the fixing belt 41. A broken line D1 in FIGS. 12A and 12B indicates the depth of the edge scratches on the fixing belt 41 after 1,000 sheets are fed and before the recovery operation is performed. A solid line D2 in FIGS. 12A and 12B indicates the depth of the edge scratches on the fixing belt 41 after the recovery operation is performed.

In a case in which the amount of movement of the passing position of the sheet P per one cell is 0.08 mm, when the predetermined number of sheets P for the edge shifting is 46 in FIG. 12A, the amount of movement of the passing position of the sheet P is 21 cells based on FIG. 11A. Therefore, the shift width β2 in FIG. 12A is 1.28 mm. By contrast, when the predetermined number of sheets P for the edge shifting is 15 in FIG. 12B, the amount of movement of the passing position of the sheet P is 64 cells based on FIG. 11B. Therefore, the shift width β3 in FIG. 12B is 2.56 mm.

As illustrated in FIGS. 12A and 12B, the amount of movement of the passing position of the sheet P after 1,000 sheets are fed is greater when the number of sheets P for the edge shifting is set to 15 than when the number of sheets P for the edge shifting is set to 46. Therefore, the passing positions of the sheet P are dispersed. With this predetermined number of sheets P, the edge scratches generated on the fixing belt 41 by burrs at both lateral ends of the sheet P can be shallower and easier to be removed by a single recovery operation (i.e., the sliding operation for two minutes in the present embodiment). Accordingly, the edge scratches formed on the surface of the fixing belt 41 becomes more difficult to be generated on an image formed on the sheet P.

In the image forming apparatus 100 according to the present embodiment, at the end of a print job with 1,000 sheets, the refresh roller 46 is brought to contact the fixing belt 41 automatically, so as to slide on the surface of the fixing belt 41. By causing the refresh roller 46 to slide on the surface of the fixing belt 41, the edge scratches generated on the surface of the fixing belt 41 are recovered to a fixed value. With this configuration, no manual recovery operation may be performed and an increase in depth of the edge scratches formed on the surface of the fixing belt 41 can be prevented by the operation by the controller 400 alone.

The configuration in which the refresh roller 46 automatically slides on the fixing belt 41 is not limited to the recovery operation after 1,000 sheets are fed. For example, the recovery operation may be performed at the end of a print job after the passing position of the sheet P has moved by 64 cells and then returned to the reference position. Further, the configuration may perform the recovery operation to cause the refresh roller 46 to contact the fixing belt 41 via the control panel 300 when gloss streaks are confirmed in an output image.

When the refresh roller 46 slides on the fixing belt 41, shavings of PFA from the surface layer of the fixing belt 41 are generated. These shavings are moved from the fixing belt 41 to the pressure roller 44 in the fixing nip region to be collected by the pressure roller cleaning device 110. According to this configuration, the shavings of PFA do not remain on the fixing belt 41 and the pressure roller 44.

Sheet types used for calculation of the left-side value in the formula (1) are, for example, non-coated papers, coated papers and special papers.

Sheet basis weights are, for example, (1) 52.3 gsm to 64 gsm, (2) 64.1 gsm to 80 gsm, . . . (8) 300.1 gsm to 350 gsm.

Sheet sizes in the width direction are, for example, (1) 105 mm or smaller, (2) 105.1 mm to 140 mm, . . . (11) 305.1 mm to 324 mm and (12) 324.1 mm or greater.

The image forming apparatus 100 according to the present embodiment includes the sheet shifting device 200 that performs edge shifting to shift the passing position of the sheet P in the width direction, relative to the reference position of the sheet P in the width direction, which is previously set. The edge shifting is performed each time the predetermined number of sheets P are fed. In the image forming apparatus 100 according to the present embodiment, the number of sheets P before shifting the passing position of the sheet P in the width direction is changed based on the sheet type, basis weight and size in the width direction, which are the parameters indicating the characteristic of the sheet P to be fed. According to this configuration, in a case in which sheets P having high burrs at both lateral ends thereof are fed, the number of sheets P set for shifting the passing position of each sheet P is reduced, and therefore the fixing belt 41 is prevented from having the edge scratches generated by burrs of the sheet P to extend deeper in the fixing belt 41.

By restraining the edge scratches from extending deeper in the fixing belt 41, the number of use of the refresh roller 46 is reduced. By reducing the number of sliding of the refresh roller 46 on the fixing belt 41, the service life of the fixing belt 41 is increased. Further, by restraining the edge scratches from extending deeper in the fixing belt 41, it becomes easier for the refresh roller 46 to remove the edge scratches from the fixing belt 41.

In a regular operation, the sheet P is fed after the sheet type and basis weight are set. However, in other operations, the setting may be made depending on sheet brands. In this case, the following formula (2) is used to determine whether the edge shifting is performed or not.

$$\Sigma\,(\text{Length in the sheet feeding direction} \times \text{Coefficient } \gamma \text{ per sheet brand}) \geq \text{Threshold for edge shifting} \quad (2).$$

The number of sheets P before shifting the passing position of the sheet P in the width direction is changed based on the sheet brand and size in the width direction. According to this configuration, in a case in which sheets P having high burrs at both lateral ends thereof are fed, the number of sheets P set for shifting the passing position of each sheet P is reduced, and therefore the fixing belt 41 is prevented from having the edge scratches generated by burrs of the sheet P to extend deeper in the fixing belt 41.

Next, a description is given of determination on whether the edge shifting is performed or not when various sheet types are mixed.

During a period from completion of an edge shifting to a subsequent edge shifting, sheets P are fed under the condition in which two or more sheets P having identical size in the width direction and different sheet types are mixed. In a case in which sheets P having identical size in the width direction and different types are fed, both lateral ends of the sheets P pass the same location on the fixing belt 41 in the width direction. Therefore, even though the sheet types are changed, the edge scratches are easy to be generated on the fixing belt 41.

The following formula (3) is used to determine whether the edge shifting is performed or not under the condition in which two (2) types of sheets P (i.e., a sheet P1 and a sheet P2) having the same size in the width direction are mixed.

$$\Sigma\,(\text{Length of the sheet } P1 \text{ in the sheet feeding direction} \times \text{Coefficient } \gamma 1 \text{ determined based on sheet type and basis weight of the sheet } P1) + \Sigma\,(\text{Length of the sheet } P2 \text{ in the sheet feeding direction} \times \text{Coefficient } \gamma 2 \text{ determined based on sheet type and basis weight of the sheet } P2) \geq \text{Threshold for edge shifting} \quad (3).$$

The following formula (4) is used to determine whether the edge shifting is performed or not under the condition in which eight (8) types of sheets P (i.e., sheets P1 to P8) having the same size in the width direction are mixed.

$$\Sigma\,(\text{Length of the sheet } P1 \text{ in the sheet feeding direction} \times \text{Coefficient } \gamma 1 \text{ determined based on sheet type and basis weight of the sheet } P1) + \Sigma\,(\text{Length of the sheet } P2 \text{ in the sheet feeding direction} \times \text{Coefficient } \gamma 2 \text{ determined based on sheet type and basis weight of the sheet } P2) + \ldots \Sigma\,(\text{Length of the sheet } P8 \text{ in the sheet feeding direction} \times \text{Coefficient } \gamma 8 \text{ determined based on sheet type and basis weight of the sheet } P8) \geq \text{Threshold for edge shifting} \quad (4).$$

As described above, by changing a value of coefficient $\gamma$ according to burrs of the sheet P, the number of sheets P before the edge shifting can be controlled properly even when the condition includes various sheet types.

The sheet shifting device 200 included in the image forming apparatus 100 according to the present embodiment shifts the sheet P that is held by the pair of registration rollers 34 in the width direction to shift the passing position of the sheet P in the width direction. The position to mount the shifting mechanism used to shift the sheet P in the width direction is not limited to the pair of registration rollers 34. In the configuration in which edge scratches on a fixing body such as the fixing belt 41 are dispersed in the width direction, the shifting mechanism may be mounted on any position between the secondary transfer nip region and the fixing nip region. Similar to the pair of registration rollers 34 in the image forming apparatus 100, the shifting mechanism is disposed upstream from the secondary transfer nip region in the sheet conveying direction. According to this configuration, when edge scratches are generated by contacting both lateral ends of the sheet P, not only the edge scratches formed on a fixing body but also the edge scratches formed on an intermediate transfer belt are dispersed in the width direction. In a case in which the shifting mechanism is disposed upstream from the secondary transfer nip region in the sheet conveying direction, which is similar in the image forming apparatus 100, the position of formation of a toner image on an intermediate transfer belt is shifted in the width direction, by the same amount as the shift amount of the passing position of the sheet P.

The image forming apparatus 100 according to the present embodiment is an example of an image forming apparatus including a function of a sheet conveying device having a shifting mechanism. However, the sheet conveying device having a shifting mechanism is not limited to an image forming apparatus.

Figure 13:
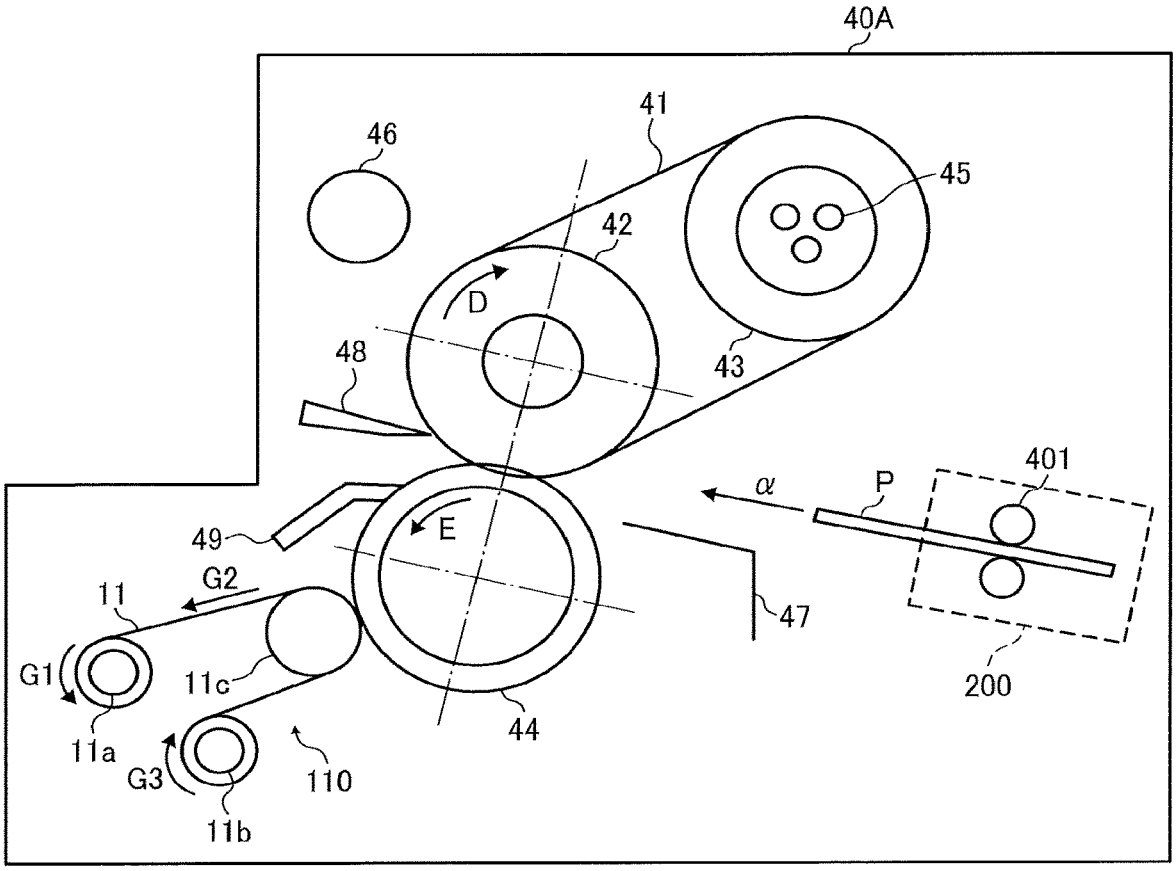
FIG. 13 is a schematic cross sectional view illustrating the fixing device including a sheet shifting device.

FIG. 13 is a diagram illustrating a fixing device 40A that includes a function of a sheet conveying device having a shifting mechanism.

The fixing device 40A illustrated in FIG. 13 includes a pair of pre-fixing conveying rollers 401 and the sheet shifting device 200. The pair of pre-fixing conveying rollers 401 is disposed upstream from the fixing nip region in the sheet conveying direction and holds the sheet P to be conveyed. The sheet shifting device 200 shifts the sheet P held by the pair of pre-fixing conveying rollers 401 in the width direction.

The fixing device 40A illustrated in FIG. 13 has the configuration identical to the fixing device 40 illustrated in FIG. 2, except that the fixing device 40A in FIG. 13 further includes the pair of pre-fixing conveying rollers 401 and the sheet shifting device 200.

In the fixing device 40A illustrated in FIG. 13, the number of sheets P before shifting the passing position of the sheet P in the width direction is changed based on the sheet type, basis weight and size in the width direction, which are the parameters indicating the characteristic of the sheet P to be conveyed. According to this configuration, in a case in which sheets P having high burrs at both lateral ends thereof are fed, the number of sheets P set for shifting the passing position of each sheet P is reduced, and therefore the fixing belt 41 is prevented from having the edge scratches generated by burrs of the sheet P to extend deeper in the fixing belt 41.

In the image forming apparatus 100 and the fixing device 40A illustrated in FIG. 13, the passing position of the sheet P in the width direction is shifted at a position upstream from the fixing belt 41 that functions as a sheet contacting body. In order to shift the passing position of a sheet in the width direction and a relative position to a sheet contacting body, the configuration in which the passing position of the sheet is shifted in the width direction of the sheet. However, the configuration is not limited thereto. For example, a configuration in which the sheet contacting body is shifted in the width direction of the sheet may be applied.

As an example of a configuration in which the sheet contacting body is shifted, a known configuration of a shifting unit such as the shifting mechanism included in the comparative fixing device may be employed.

The configurations according to the above-descried embodiments are not limited thereto. This disclosure can achieve the following aspects effectively.

Aspect A.

In Aspect A, a sheet conveying device (for example, the image forming apparatus 100 and the fixing device 40) includes a sheet contacting body (for example, the fixing belt 41) configured to contact a sheet (for example, the sheet P) to be conveyed, and a lateral relative position shifting body (for example, the controller 400 and the sheet shifting device 200) configured to shift a passing position of the sheet being conveyed toward the sheet contacting body, in a width direction perpendicular to a sheet conveying direction and a relative position to the sheet contacting body, each time the sheet is conveyed by a number of sheets based on a setting. The setting of the number of sheets varies based on information of the sheet (for example, the parameters of characteristics of the sheet P).

According to this configuration, as described in the above-described embodiments, when the sheet to be conveyed is a sheet that can easily cause an edge scratch or edge scratches by the edge of the sheet to the sheet contacting body, the specified number of sheets can be reduced until the relative position is shifted. Accordingly, the edge scratch or scratches onto the sheet contacting body is restrained from becoming deeper.

Aspect B.

In Aspect A, the sheet conveying device (for example, the image forming apparatus 100 and the fixing device 40) further includes a sliding body (for example, the refresh roller 46) configured to slide on a surface of the sheet contacting body (for example, the fixing belt 41). The sheet contacting body is a surface moving body having a surface to move endlessly.

According to this configuration, as described in the above-described embodiments, the sliding body can fix and repair the edge scratch on the surface of the sheet contacting body.

Aspect C.

In Aspect B, the sheet conveying device (for example, the image forming apparatus 100 and the fixing device 40) further includes a sliding body (for example, the refresh roller 46) configured to slide on a surface of the sheet contacting body (for example, the fixing belt 41). The sheet contacting body is a surface moving body having a surface to move endlessly.

According to this configuration, as described in the above-described embodiment, the edge scratch on the surface of the sheet contacting body can be fixed and repaired easily.

Aspect D.

In Aspect B or Aspect C, the sliding body (for example, the refresh roller 46) is configured to contact and slide on the sheet contacting body (for example, the fixing belt 41) each time the sheet is conveyed by a number of sheets determined based on a setting.

According to this configuration, as described in the above-described embodiments, the surface of the sheet contacting body is slid at constant intervals. By so doing, the edge scratches on the surface of the sheet contacting body can be restrained and fixed, and the sliding body can fix and repair the edge scratch on the surface of the sheet contacting body and can prevent the scratches from becoming deeper beyond a constant amount.

Aspect E.

In any one of Aspect B through Aspect D, the sliding body (for example, the refresh roller 46) is configured to contact and slide on the sheet contacting body (for example, the fixing belt 41) each time sheet shifting is performed by a number of times determined based on a setting.

According to this configuration, as described in the above-described embodiments, the surface of the sheet contacting body is slid at constant intervals. By so doing, the edge scratches on the surface of the sheet contacting body can be restrained and fixed, and the sliding body can fix and repair the edge scratch on the surface of the sheet contacting body and can prevent the scratches from becoming deeper beyond a constant amount.

Aspect F.

In any one of Aspect B through Aspect E, the sheet conveying device (for example, the image forming apparatus 100 and the fixing device 40) further includes a pressing body (for example, the pressure roller 44) configured to press the sheet contacting body (for example, the fixing belt 41) and hold the sheet with the sheet contacting body. The sheet contacting body is a belt stretched by multiple tension bodies. When the sliding body (for example, the refresh roller 46) slides on the sheet contacting body, the pressing body is in a pressing state to the sheet contacting body.

According to this configuration, as described in the above-described embodiments, the sheet contacting body that is a belt (i.e., the fixing belt 41) can be restrained from slipping due to sliding of the sliding body.

Aspect G.

In Aspect F, the sheet conveying device (for example, the image forming apparatus 100 and the fixing device 40) further includes a pressing body cleaner (for example, the pressure roller cleaning device 110) configured to clean a surface of the pressing body (for example, the pressure roller 44). The pressing body is a surface moving body having a surface to move endlessly.

According to this configuration, as described in the above-described embodiments, shavings generated by sliding on the sheet contacting body (for example, the fixing belt 41) do not remain on the surface of the sheet contacting body and the pressing body.

Aspect H.

An image forming apparatus (for example, the image forming apparatus 100) includes an image forming device (for example, the image forming units 2, the primary transfer unit 60 and the secondary transfer unit 78) configured to form an image on a sheet (for example, the sheet P), and the sheet conveying device according to any one of Aspect A through Aspect G, configured to convey the sheet.

According to this configuration, as described in the above-described embodiment, occurrence of failures such as gloss streaks due to deeper edge scratches caused to the sheet contacting body (for example, the fixing belt 41) can be restrained.

Aspect I.

In Aspect H, the image forming apparatus (for example, the image forming apparatus 100) further includes a fixing device (for example, the fixing device 40) having a fixing body (for example, the fixing belt 41) and is configured to fix the image to the sheet while causing the fixing body to contact a surface of the sheet. The sheet contacting body is the fixing body.

According to this configuration, as described in the above-described embodiment, occurrence of defect images such as images with gloss streaks due to deeper edge scratches caused to the fixing body can be restrained.

Aspect J.

A fixing device (for example, the fixing device 40) includes a fixing body (for example, the fixing belt 41) configured to contact a sheet (for example, the sheet P) being conveyed and having an image formed thereon and to fix the image to the sheet, and the sheet conveying device (for example, the fixing device 40) according to any one of Aspect A through Aspect G. The sheet contacting body is the fixing body.

According to this configuration, as described in the above-described embodiment, occurrence of fixing failure such as images with gloss streaks due to deeper edge scratches caused to the fixing body can be restrained.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device, comprising:

a sheet contacting body that contacts a sheet being conveyed in a sheet conveying direction;

a lateral relative position shifting body that shifts a passing position of the sheet being conveyed in a width direction toward the sheet contacting body and a relative position to the sheet contacting body; and a sliding body that slides on a surface of the sheet contacting body to remove scratches from the sheet contacting body, wherein the width direction is perpendicular to the sheet conveying direction, the lateral relative position shifting body shifts the passing position of sheets conveyed by a shifting distance, each time a number of sheets is conveyed, based on a setting that varies according to information indicating characteristics of the number of sheets, and the number of sheets, before shifting the passing position of the sheet in the width direction, is changed based on a sheet type, a basis weight and a size in the width direction.

2. The sheet conveying device according to claim 1, wherein the sheet contacting body is a surface moving body having the surface to move endlessly.

3. The sheet conveying device according to claim 2, wherein the sliding body is a surface moving body having a surface which moves endlessly, and a surface moving speed of the sliding body is greater than a surface moving speed of the sheet contacting body.

4. The sheet conveying device according to claim 2, wherein the sliding body contacts and slides on the sheet contacting body each time the number of sheets is conveyed, and the number of the number of sheets is determined based on the setting.

5. The sheet conveying device according to claim 2, wherein the sliding body contacts and slides on the sheet contacting body each time a number of sheet shifts is performed, and the number of the number of sheet shifts is determined based on the setting.

6. The sheet conveying device according to claim 2, further comprising:

a pressing body that presses the sheet contacting body and holds the sheet with the sheet contacting body, wherein the sheet contacting body is a belt stretched by multiple tension bodies, and in a case that the sliding body slides on the sheet contacting body, the pressing body is in a pressing state to the sheet contacting body.

7. The sheet conveying device according to claim 6, further comprising:

a pressing body cleaner that cleans a surface of the pressing body, wherein the pressing body is a surface moving body having a surface to move endlessly.

8. An image forming apparatus, comprising:

the sheet conveying device according to claim 1; and an image forming device that forms an image on the sheet.

9. The image forming apparatus according to claim 8, wherein the sheet contacting body is a fixing body, and the image forming apparatus further comprises a fixing device having the fixing body, wherein the fixing device fixes the image to the sheet while the fixing body contacts a surface of the sheet.

10. A fixing device, comprising:

the sheet conveying device according to claim 1, wherein the sheet contacting body is a fixing body that contacts the sheet being conveyed, and the fixing body having an image formed thereon to fix the image to the sheet.

11. An apparatus, comprising:

a controller configured to receive information indicating characteristics of a number of sheets to be conveyed;

a sheet contacting body that contacts a sheet being conveyed in a sheet conveying direction;

a lateral relative position shifting body that shifts a passing position of the sheet being conveyed in a width direction toward the sheet contacting body and a relative position to the sheet contacting body; and a sliding body that slides on a surface of the sheet contacting body to remove scratches from the sheet contacting body, wherein the width direction is perpendicular to the sheet conveying direction, the controller is further configured to control, based on a setting that varies according to the information, the lateral relative position shifting body to shift the passing position of sheets conveyed by a shifting distance each time number of sheets is conveyed, and the number of sheets, before shifting the passing position of the sheet in the width direction, is changed based on a sheet type, a basis weight and a size in the width direction.

12. The sheet conveying device according to claim 11, wherein the sheet contacting body is a surface moving body having the surface to move endlessly.

13. The apparatus according to claim 11, wherein the sliding body is a surface moving body having a surface which moves endlessly, and a surface moving speed of the sliding body is greater than a surface moving speed of the sheet contacting body.

14. The apparatus according to claim 11, wherein the sliding body contacts and slides on the sheet contacting body each time the number of sheets is conveyed, and the controller determines the number of the number of sheets based on the setting.

15. The apparatus according to claim 11, wherein the sliding body contacts and slides on the sheet contacting body each time a number of sheet shifts is performed, and the controller determines the number of the number of sheet shifts based on the setting.

16. The apparatus according to claim 11, further comprising:

a pressing body that presses the sheet contacting body and holds the sheet with the sheet contacting body, wherein the sheet contacting body is a belt stretched by multiple tension bodies, and in a case that the sliding body slides on the sheet contacting body, the pressing body is in a pressing state to the sheet contacting body.

17. The sheet conveying device according to claim 16, further comprising:

a pressing body cleaner that cleans a surface of the pressing body, wherein the pressing body is a surface moving body having a surface to move endlessly.

18. The sheet conveying device according to claim 2, wherein the sliding body is at a position after the sheet is separated from the sheet contacting body along the sheet conveying direction.

19. The sheet conveying device according to claim 3, wherein the surface moving speed of the sliding body is 3 to 6 times greater than the surface moving speed of the sheet contacting body.

* * * * *